US011015287B1

(12) United States Patent
Hussain et al.

(10) Patent No.: US 11,015,287 B1
(45) **Date of Patent: *May 25, 2021**

(54) PROCESSES FOR MAKING IMPROVED CELLULOSE-BASED MATERIALS AND CONTAINERS

(71) Applicant: INTERNATIONAL PAPER COMPANY, Memphis, TN (US)

(72) Inventors: Sadakat Hussain, Memphis, TN (US); James D. Regel, Loveland, OH (US)

(73) Assignee: INTERNATIONAL PAPER COMPANY, Memphis, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/916,382

(22) Filed: Jun. 30, 2020

(51) Int. Cl.

| | |
|---|---|
| ***D06M 15/00*** | (2006.01) |
| ***D06M 15/59*** | (2006.01) |
| ***D21F 11/12*** | (2006.01) |
| ***D06M 15/267*** | (2006.01) |
| *D06M 101/06* | (2006.01) |

(52) U.S. Cl.
CPC ..... *D06M 15/59* (2013.01); *D06M 15/267* (2013.01); *D21F 11/12* (2013.01); *D06M 2101/06* (2013.01)

(58) Field of Classification Search
CPC ..... D06M 15/59; D06M 2101/34; D06M 2101/36; D06M 7/00; D06M 2101/06; D06M 23/00; D06M 13/402; D06M 15/05; D06M 17/04; D06M 23/18; D06M 13/52; D06M 13/41; D06M 14/16
USPC ..... 8/116.1
See application file for complete search history.

(56) References Cited

U.S. PATENT DOCUMENTS

| | | | |
|---|---|---|---|
| 6,194,057 | B1 | 2/2001 | Schennum |
| 6,939,443 | B2 | 9/2005 | Ryan |
| 7,648,772 | B2 | 1/2010 | Grant |
| 7,682,486 | B2 | 3/2010 | Mohan |
| 7,955,670 | B2 | 6/2011 | Swoboda |
| 8,512,519 | B2 | 8/2013 | Gupta |
| 8,617,692 | B2 | 12/2013 | Grant |
| 9,212,453 | B2 | 12/2015 | Luo |
| 9,605,382 | B2 | 3/2017 | Virtanen |
| 9,605,383 | B2 | 3/2017 | Jogikalmath |

(Continued)

FOREIGN PATENT DOCUMENTS

| | | | |
|---|---|---|---|
| EP | 2948591 | B1 | 10/2017 |
| JP | 2015206147 | A | 11/2015 |

(Continued)

OTHER PUBLICATIONS

Biancolini et al., "Numerical and Experimental Investigation of the Strength of Corrugated Board Packages", Packaging Technology and Science, vol. 16, Issue No. 2, pp. 47-60, 2003.

(Continued)

*Primary Examiner* — Eisa B Elhilo
(74) *Attorney, Agent, or Firm* — Barnes & Thornburg LLP; Thomas W. Ryan

(57) ABSTRACT

The present disclosure provides processes for making cellulose-based material and containers utilizing the cellulose-based material. More particularly, the present disclosure provides processes to make cellulose-based material comprising strength-enhancing preparations and processes to make improved containers with the strength-enhanced cellulose-based materials.

19 Claims, 5 Drawing Sheets

(56) References Cited

U.S. PATENT DOCUMENTS

| | | | | |
|---|---|---|---|---|
| 10,378,154 | B2 | 8/2019 | Luo | |
| 10,407,831 | B2 | 9/2019 | Hietaniemi | |
| 10,458,068 | B2 | 10/2019 | Lu | |
| 2003/0127209 | A1 | 7/2003 | Sandberg | |
| 2006/0144541 | A1 | 7/2006 | Joy Nickel | |
| 2009/0159224 | A1 | 6/2009 | Chou | |
| 2009/0272505 | A1 | 11/2009 | Champ | |
| 2010/0151164 | A1* | 6/2010 | Grant | D21H 27/10 428/34.2 |
| 2018/0148894 | A1 | 5/2018 | Hemmes | |
| 2018/0171561 | A1 | 6/2018 | Sundblad | |
| 2018/0313039 | A1 | 11/2018 | Tuszkiewicz | |
| 2019/0153676 | A1 | 5/2019 | Pal | |
| 2019/0271115 | A1 | 9/2019 | Hamers | |
| 2019/0309476 | A1 | 10/2019 | Karisalmi | |
| 2020/0010255 | A1 | 1/2020 | Zacherle | |
| 2020/0080264 | A1 | 3/2020 | Virtanen | |
| 2020/0283958 | A1 | 9/2020 | Mustonen | |

FOREIGN PATENT DOCUMENTS

| | | | |
|---|---|---|---|
| WO | WO-2015036930 | A1 | 7/2016 |
| WO | WO-2015036932 | | 7/2016 |
| WO | WO-2016209155 | A1 | 12/2016 |
| WO | WO-2019145846 | A1 | 8/2019 |
| WO | WO-2020016310 | A1 | 1/2020 |
| WO | WO-2020041253 | A1 | 2/2020 |

OTHER PUBLICATIONS

Hubbe, "Paper", North Carolina State University, Raleigh, Jul. 15, 2005, 50 pages.

* cited by examiner

PROCESSES FOR MAKING IMPROVED CELLULOSE-BASED MATERIALS AND CONTAINERS

BACKGROUND

The present disclosure relates to processes for making cellulose-based material and processes to making containers utilizing the cellulose-based material. More particularly, the present disclosure relates to processes for making cellulose-based material comprising strength-enhancing preparations and processes for making improved containers with the strength-enhanced cellulose-based materials.

SUMMARY

Containers are used to store, ship, and protect a multitude of products from damage. Typically, such containers may be stacked on top of each other during general use, thus exposing certain containers within the stack to significant weight loads. As a result, the strength of the containers and the materials that comprise the containers is of extreme importance.

Moreover, environmental factors must be taken into consideration when designing containers. For instance, containers comprising cellulosic fibers are subject to swelling due to the absorbance of water by the fibers, thus weakening the containers. As a result, containers used in activities that have a high relative humidity (e.g., the food supply chain) must be prepared with sufficient strength characteristics in order to avoid weakening due to the humid conditions.

Therefore, the present disclosure provides processes for making cellulose-based materials and processes for making containers therefrom that address the desired strength and performance issues known in the art. A processes for making cellulose-based material in accordance with the present disclosure includes a step of treating cellulosic fibers with i) a dry strength chemistry preparation and ii) a wet strength chemistry preparation in a paper-making machine to provide the cellulose-based material. Furthermore, the cellulose-based material made in accordance with the processes of the present disclosure can be utilized in making containers as described herein.

The processes of making the cellulose-based materials and containers of the present disclosure provide several advantages and improvements compared to the state of the art. First, process to make the cellulose-based material includes treating cellulosic fibers with both a dry strength chemistry preparation and a wet strength chemistry preparation in order to provide significant strength improvement (i.e., a significant reduction in strength loss) that is observed in both the cellulose-based material and containers made using the cellulose-based material. Further, the improvement in strength can be observed at conditions of high relative humidity in order to provide significant advantages for activities performed in such humid conditions. In addition, the cellulose-based materials and containers made according to the processes of the present disclosure are recyclable, repulpable, and capable of being recycled, which are highly desired from an environmental perspective. Moreover, a synergistic effect in strength improvement can be observed for containers prepared using a combination of a dry strength chemistry preparation and a wet strength preparation in the cellulose-based materials. This synergistic effect was surprising and unexpected.

In illustrative embodiments, a process for making a cellulose-based material is provided. For these embodiments, the process comprises the step of treating cellulosic fibers with i) a dry strength chemistry preparation and ii) a wet strength chemistry preparation in a paper-making machine to provide the cellulose-based material.

In illustrative embodiments, process for making a container is provided. For these embodiments, the process comprising the steps of treating cellulosic fibers with i) a dry strength chemistry preparation and ii) a wet strength chemistry preparation in a paper-making machine to provide a cellulose-based material; forming a container blank using the cellulose-based material; and forming a container using the cellulose-based material.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

The detailed description particularly refers to the accompanying figures in which:

As shown in FIG. 1, two linerboard compositions are provided for the outer layers of the containerboard and one medium composition is provided for the fluted inner layer that is sinusoidal in shape.

DETAILED DESCRIPTION

Figure 1:
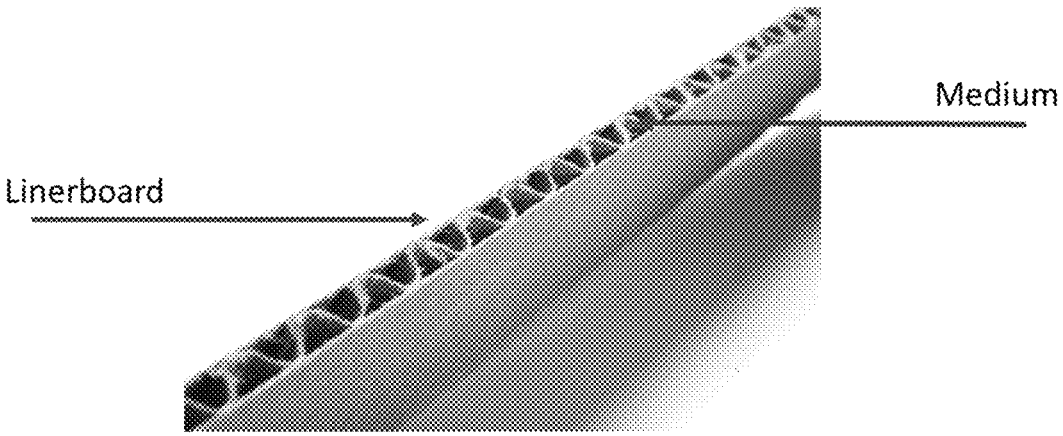
FIG. 1 is a view of an exemplary containerboard formed from processes to make the cellulose-based material described herein.

In illustrative aspect, a process for making a cellulose-based material is provided. The process comprises the step of treating cellulosic fibers with i) a dry strength chemistry preparation and ii) a wet strength chemistry preparation in a paper-making machine to provide the cellulose-based material.

In an embodiment, the cellulose-based material is a paper-based material. In an embodiment, the cellulose-based material is paper. In an embodiment, the cellulose-based material is a paper board. In an embodiment, the cellulose-based material is a medium. A "medium" is well known in the art as an inner layer of a containerboard. For instance, in some embodiments, a medium may be fluted and/or sinusoidal in shape. In an embodiment, the cellulose-based material is a liner. A "liner" is well known in the art as an outer layer of a containerboard. In an embodiment, the cellulose-based material is a containerboard. In an embodiment, the cellulose-based material is recyclable. For instance, cellulose-based materials are known in the art to be certified for recycling. One such example of certification is by the Fibre Box Association (FBA) and various certifications are well known in the art.

In an aspect, the cellulosic fibers comprise virgin fibers. In an aspect, the cellulosic fibers comprise recycled fibers. In an aspect, the cellulosic fibers comprise a combination of virgin fibers and recycled fibers. In an aspect, the cellulosic fibers are capable of being recycled. In an aspect, the cellulose-based material is capable of being recycled.

The combination of virgin fibers and recycled fibers may fall within one of several different ranges. The combination may be one of the following ranges (in which the total percentage is 100%): about 1% to about 99% virgin fibers and about 1% to about 99% recycled fibers, about 5% to about 95% virgin fibers and about 5% to about 95% recycled fibers, about 10% to about 90% virgin fibers and about 10% to about 90% recycled fibers, about 15% to about 85% virgin fibers and about 15% to about 85% recycled fibers, about 20% to about 80% virgin fibers and about 20% to about 80% recycled fibers, about 25% to about 75% virgin fibers and about 25% to about 75% recycled fibers, about 30% to about 70% virgin fibers and about 30% to about 70% recycled fibers, about 35% to about 65% virgin fibers and about 35% to about 65% recycled fibers, about 40% to about 60% virgin fibers and about 40% to about 60% recycled fibers, about 45% to about 55% virgin fibers and about 45% to about 55% recycled fibers, about 48% to about 52% virgin fibers and about 48% to about 52% recycled fibers, and about 50% virgin fibers and about 50% recycled fibers.

In an embodiment, the dry strength chemistry preparation comprises an aldehyde functionalized polymer. In an embodiment, the dry strength chemistry preparation comprises glyoxalated polyacrylamide (GPAM). GPAM can be supplied, for example, as Solenis Hercobond Plus 555 (aka BASF Luredur Plus 555), as Solenis Hercobond Plus HC (aka BASF Luredur Plus HC), or as other GPAM formulations known in the art.

In an embodiment, the GPAM is applied to the cellulosic fibers between 1-16 dry lbs/ton. In an embodiment, the GPAM is applied to the cellulosic fibers between 2-8 dry lbs/ton. In an embodiment, the GPAM is applied to the cellulosic fibers at 2 dry lbs/ton. In an embodiment, the GPAM is applied to the cellulosic fibers at 4 dry lbs/ton. In an embodiment, the GPAM is applied to the cellulosic fibers at 6 dry lbs/ton. In an embodiment, the GPAM is applied to the cellulosic fibers at 8 dry lbs/ton.

In an aspect, the wet strength chemistry preparation comprises a polyamide resin. In an aspect, the polyamide resin is a polyamidoamine epihalohydrin resin. In an aspect, the polyamide resin is selected from the group consisting of EPI-Polyamide resin, Polyamide-Epichlorohydrin resin (PAE), and Epichlorohydrin polyamide resin. In an aspect, the polyamide resin is Polyamide-Epichlorohydrin resin (PAE). The wet strength chemistry preparation can be supplied, for example, as Kymene 1500LV, as Nalco 63642, or as other wet strength chemistry formulations known in the art.

In an aspect, the polyamide resin is applied to the cellulosic fibers between 1-32 dry lbs/ton. In an aspect, the polyamide resin is applied to the cellulosic fibers between 2-16 dry lbs/ton. In an aspect, the polyamide resin is applied to the cellulosic fibers between 2-8 dry lbs/ton. In an aspect, the polyamide resin is applied to the cellulosic fibers at 2 dry lbs/ton. In an aspect, the polyamide resin is applied to the cellulosic fibers at 4 dry lbs/ton. In an aspect, the polyamide resin is applied to the cellulosic fibers at 6 dry lbs/ton. In an aspect, the polyamide resin is applied to the cellulosic fibers at 8 dry lbs/ton.

In an embodiment, the process further comprises a step of treating cellulosic fibers with a sizing agent. In an embodiment, the sizing agent is an internal sizing agent. In an embodiment, the sizing agent is a surface sizing agent. In an embodiment, the sizing agent is alkenyl succinic anhydride (ASA). In an embodiment, the sizing agent is rosin. In an embodiment, the sizing agent is alkyl ketene dimer (AKD).

In an aspect, the cellulosic fibers are treated with the dry strength chemistry preparation and the wet strength chemistry preparation at the same time. In an aspect, the cellulosic fibers are treated with the dry strength chemistry preparation and the wet strength chemistry preparation sequentially, in either order. In an aspect, the cellulosic fibers are treated with the dry strength chemistry preparation and the wet strength chemistry preparation separately. In an aspect, the dry strength chemistry preparation and the wet strength chemistry preparation are combined prior to treating the cellulosic fibers.

In an embodiment, the process further comprises treating cellulosic fibers with an enzymatic preparation. In an embodiment, the enzymatic preparation comprises a polypeptide having amylase activity. In an embodiment, the process does not comprise treating cellulosic fibers with an enzymatic preparation.

In an aspect, the process further comprises treating cellulosic fibers with an anionic surface preparation. In an aspect, the anionic surface preparation is an anionic polyacrylamide. In an aspect, the anionic surface preparation is a copolymer of acrylamide and unsaturated carboxylic acid monomers, being (meth)acrylic acid, maleic acid, crotonic acid, itaconic acid, or any combination thereof. In an aspect, the process does not comprise treating cellulosic fibers with an anionic surface preparation.

The cellulose-based materials made by the process of the present disclosure may be determined to have certain properties. For example, the cellulose-based material has a basis weight. A basis weight is generally understood in the paper making arts to represent the mass per unit of area of the cellulose-based materials. For instance, the cellulose-based materials of the present disclosure can be contrasted to comparative cellulose-based materials having a similar basis weight in which the comparative cellulose-based materials lack the wet strength chemistry preparation, lack the dry strength chemistry preparation, or lack both the wet strength chemistry preparation and the dry strength chemistry preparation.

In an embodiment, the cellulose-based material has a basis weight and a short-span compression strength (SCT). Means of evaluating compression strength of a cellulose-based material via SCT (also known as "STFI") are well known in the art. In an embodiment, the SCT is greater than a comparative SCT for a comparative cellulose-based material made on the paper-making machine, wherein the comparative cellulose-based material having the basis weight and lacking the dry strength chemistry preparation and the wet strength chemistry preparation. In an embodiment, the greater SCT is observed at a dry relative humidity. In an embodiment, the greater SCT is observed at a high relative humidity. For instance, a "high relative humidity" can refer to a relative humidity of 50% or greater, a relative humidity of 55% or greater, a relative humidity of 60% or greater, a relative humidity of 65% or greater, a relative humidity of 70% or greater, a relative humidity of 75% or greater, a relative humidity of 80% or greater, a relative humidity of 85% or greater, a relative humidity of 90% or greater, or a relative humidity of 95% or greater.

In an embodiment, the SCT is greater than a comparative SCT for a comparative cellulose-based material made on the paper-making machine, wherein the comparative cellulose-based material having the basis weight and lacking the dry strength chemistry preparation. In an embodiment, the greater SCT is observed at a dry relative humidity. In an embodiment, the greater SCT is observed at a high relative humidity.

In an embodiment, the SCT is greater than a comparative SCT for a comparative cellulose-based material made on the paper-making machine, wherein the comparative cellulose-based material having the basis weight and lacking the wet strength chemistry preparation. In an embodiment, the greater SCT is observed at a dry relative humidity. In an embodiment, the greater SCT is observed at a high relative humidity.

In an embodiment, the dry strength chemistry preparation and the wet strength chemistry preparation provide a synergistic increase in SCT for the cellulose-based material in comparison to the comparative cellulose-based material. In an embodiment, the synergistic increase in SCT is observed at a dry relative humidity. In an embodiment, the synergistic increase in SCT is observed at a high relative humidity. The synergistic increase in SCT for the cellulose-based materials of the present disclosure is demonstrated in the subsequent examples and was unexpected.

In an embodiment, the cellulose-based material has a basis weight and short-span compression strength index (SCT Index). Generally, determining the SCT Index of a cellulose-based material is well known in the art by dividing the average SCT value of the cellulose-based material by the average basis weight of the cellulose-based material. In an embodiment, the SCT Index is greater than a comparative SCT Index for a comparative cellulose-based material made on the paper-making machine, wherein the comparative cellulose-based material having the basis weight and lacking the dry strength chemistry preparation and the wet strength chemistry preparation. In an embodiment, the greater SCT Index is observed at a dry relative humidity. In an embodiment, the greater SCT Index is observed at a high relative humidity.

In an embodiment, the SCT Index is greater than a comparative SCT Index for a comparative cellulose-based material made on the paper-making machine, wherein the comparative cellulose-based material having the basis weight and lacking the dry strength chemistry preparation. In an embodiment, the greater SCT Index is observed at a dry relative humidity. In an embodiment, the greater SCT Index is observed at a high relative humidity.

In an embodiment, the SCT Index is greater than a comparative SCT Index for a comparative cellulose-based material made on the paper-making machine, wherein the comparative cellulose-based material having the basis weight and lacking the wet strength chemistry preparation. In an embodiment, the greater SCT Index is observed at a dry relative humidity. In an embodiment, the greater SCT Index is observed at a high relative humidity.

In an embodiment, the dry strength chemistry preparation and the wet strength chemistry preparation provide a synergistic increase in SCT Index for the cellulose-based material in comparison to the comparative cellulose-based material. In an embodiment, the synergistic increase in SCT Index is observed at a dry relative humidity. In an embodiment, the synergistic increase in SCT Index is observed at a high relative humidity. The synergistic increase in SCT Index for the cellulose-based materials of the present disclosure is demonstrated in the subsequent examples and was unexpected.

In an embodiment, the cellulose-based material has a basis weight and a Concora value. Means of evaluating flat crush of a cellulose-based material via Concora are well known in the art. In an embodiment, the Concora value is greater than a comparative Concora value for a comparative cellulose-based material made on the paper-making machine, wherein the comparative cellulose-based material having the basis weight and lacking the dry strength chemistry preparation and the wet strength chemistry preparation. In an embodiment, the greater Concora value is observed at a dry relative humidity. In an embodiment, the greater Concora value is observed at a high relative humidity.

In an embodiment, the Concora value is greater than a comparative Concora value for a comparative cellulose-based material made on the paper-making machine, wherein the comparative cellulose-based material having the basis weight and lacking the dry strength chemistry preparation. In an embodiment, the greater Concora value is observed at a dry relative humidity. In an embodiment, the greater Concora value is observed at a high relative humidity.

In an embodiment, the Concora value is greater than a comparative Concora value for a comparative cellulose-based material made on the paper-making machine, wherein the comparative cellulose-based material having the basis weight and lacking the wet strength chemistry preparation. In an embodiment, the greater Concora value is observed at a dry relative humidity. In an embodiment, the greater Concora value is observed at a high relative humidity.

In an embodiment, the dry strength chemistry preparation and the wet strength chemistry preparation provide a synergistic increase in Concora value for the cellulose-based material in comparison to the comparative cellulose-based material. In an embodiment, the synergistic increase in Concora value is observed at a dry relative humidity. In an embodiment, the synergistic increase in Concora value is observed at a high relative humidity. The synergistic increase in Concora value for the cellulose-based materials of the present disclosure is demonstrated in the subsequent examples and was unexpected.

In an illustrative aspect, a process for making a container is provided. The process comprising the steps of treating cellulosic fibers with i) a dry strength chemistry preparation and ii) a wet strength chemistry preparation in a paper-making machine to provide a cellulose-based material, forming a container blank using the cellulose-based material, and forming a container using the cellulose-based material.

In an embodiment, the cellulose-based material is recyclable. For instance, cellulose-based materials are known in the art to be certified for recycling. One such example of certification is by the Fibre Box Association (FBA) and various certifications are well known in the art. In an embodiment, the container is corrugated cardboard.

In an aspect, the cellulosic fibers comprise virgin fibers. In an aspect, the cellulosic fibers comprise recycled fibers. In an aspect, the cellulosic fibers comprise a combination of virgin fibers and recycled fibers. In an aspect, the cellulosic fibers are capable of being recycled. In an aspect, the container is capable of being recycled.

The combination of virgin fibers and recycled fibers may fall within one of several different ranges. The combination may be one of the following ranges (in which the total percentage is 100%): about 1% to about 99% virgin fibers and about 1% to about 99% recycled fibers, about 5% to about 95% virgin fibers and about 5% to about 95% recycled fibers, about 10% to about 90% virgin fibers and about 10% to about 90% recycled fibers, about 15% to about 85% virgin fibers and about 15% to about 85% recycled fibers, about 20% to about 80% virgin fibers and about 20% to about 80% recycled fibers, about 25% to about 75% virgin fibers and about 25% to about 75% recycled fibers, about 30% to about 70% virgin fibers and about 30% to about 70% recycled fibers, about 35% to about 65% virgin fibers and about 35% to about 65% recycled fibers, about 40% to about 60% virgin fibers and about 40% to about 60% recycled fibers, about 45% to about 55% virgin fibers and about 45% to about 55% recycled fibers, about 48% to about 52% virgin fibers and about 48% to about 52% recycled fibers, and about 50% virgin fibers and about 50% recycled fibers.

In an embodiment, the dry strength chemistry preparation comprises an aldehyde functionalized polymer. In an embodiment, the dry strength chemistry preparation comprises glyoxalated polyacrylamide (GPAM). GPAM can be supplied, for example, as Solenis Hercobond Plus 555 (aka BASF Luredur Plus 555), as Solenis Hercobond Plus HC (aka BASF Luredur Plus HC), or as other GPAM formulations known in the art.

In an embodiment, the GPAM is applied to the cellulosic fibers between 1-16 dry lbs/ton. In an embodiment, the GPAM is applied to the cellulosic fibers between 2-8 dry lbs/ton. In an embodiment, the GPAM is applied to the cellulosic fibers at 2 dry lbs/ton. In an embodiment, the GPAM is applied to the cellulosic fibers at 4 dry lbs/ton. In an embodiment, the GPAM is applied to the cellulosic fibers at 6 dry lbs/ton. In an embodiment, the GPAM is applied to the cellulosic fibers at 8 dry lbs/ton.

In an aspect, the wet strength chemistry preparation comprises a polyamide resin. In an aspect, the polyamide resin is a polyamidoamine epihalohydrin resin. In an aspect, the polyamide resin is selected from the group consisting of EPI-Polyamide resin, Polyamide-Epichlorohydrin resin (PAE), and Epichlorohydrin polyamide resin. In an aspect, the polyamide resin is Polyamide-Epichlorohydrin resin (PAE). The wet strength chemistry preparation can be supplied, for example, as Kymene 1500LV, as Nalco 63642, or as other wet strength chemistry formulations known in the art.

In an aspect, the polyamide resin is applied to the cellulosic fibers between 1-32 dry lbs/ton. In an aspect, the polyamide resin is applied to the cellulosic fibers between 2-16 dry lbs/ton. In an aspect, the polyamide resin is applied to the cellulosic fibers between 2-8 dry lbs/ton. In an aspect, the polyamide resin is applied to the cellulosic fibers at 2 dry lbs/ton. In an aspect, the polyamide resin is applied to the cellulosic fibers at 4 dry lbs/ton. In an aspect, the polyamide resin is applied to the cellulosic fibers at 6 dry lbs/ton. In an aspect, the polyamide resin is applied to the cellulosic fibers at 8 dry lbs/ton.

In an embodiment, the process further comprises a step of treating cellulosic fibers with a sizing agent. In an embodiment, the sizing agent is an internal sizing agent. In an embodiment, the sizing agent is a surface sizing agent. In an embodiment, the sizing agent is alkenyl succinic anhydride (ASA). In an embodiment, the sizing agent is rosin. In an embodiment, the sizing agent is alkyl ketene dimer (AKD).

In an aspect, the cellulosic fibers are treated with the dry strength chemistry preparation and the wet strength chemistry preparation at the same time. In an aspect, the cellulosic fibers are treated with the dry strength chemistry preparation and the wet strength chemistry preparation sequentially, in either order. In an aspect, the cellulosic fibers are treated with the dry strength chemistry preparation and the wet strength chemistry preparation separately. In an aspect, the dry strength chemistry preparation and the wet strength chemistry preparation are combined prior to treating the cellulosic fibers.

In an embodiment, the process further comprises treating cellulosic fibers with an enzymatic preparation. In an embodiment, the enzymatic preparation comprises a polypeptide having amylase activity. In an embodiment, the process does not comprise treating cellulosic fibers with an enzymatic preparation.

In an aspect, the process further comprises treating cellulosic fibers with an anionic surface preparation. In an aspect, the anionic surface preparation is an anionic polyacrylamide. In an aspect, the anionic surface preparation is a copolymer of acrylamide and unsaturated carboxylic acid monomers, being (meth)acrylic acid, maleic acid, crotonic acid, itaconic acid, or any combination thereof. In an aspect, the process does not comprise treating cellulosic fibers with an anionic surface preparation.

The cellulose-based materials made by the process of the present disclosure may be determined to have certain properties. For example, the cellulose-based material has a basis weight. A basis weight is generally understood in the paper making arts to represent the mass per unit of area of the cellulose-based materials. For instance, the cellulose-based materials of the present disclosure can be contrasted to comparative cellulose-based materials having a similar basis weight in which the comparative cellulose-based materials lack the wet strength chemistry preparation, lack the dry strength chemistry preparation, or lack both the wet strength chemistry preparation and the dry strength chemistry preparation.

In an embodiment, the cellulose-based material has a basis weight and a short-span compression strength (SCT). Means of evaluating compression strength of a cellulose-based material via SCT (also known as "STFI") are well known in the art. In an embodiment, the SCT is greater than a comparative SCT for a comparative cellulose-based material made on the paper-making machine, wherein the comparative cellulose-based material having the basis weight and lacking the dry strength chemistry preparation and the wet strength chemistry preparation. In an embodiment, the greater SCT is observed at a dry relative humidity. In an embodiment, the greater SCT is observed at a high relative humidity. For instance, a "high relative humidity" can refer to a relative humidity of 50% or greater, a relative humidity of 55% or greater, a relative humidity of 60% or greater, a relative humidity of 65% or greater, a relative humidity of 70% or greater, a relative humidity of 75% or greater, a relative humidity of 80% or greater, a relative humidity of 85% or greater, a relative humidity of 90% or greater, or a relative humidity of 95% or greater.

In an embodiment, the SCT is greater than a comparative SCT for a comparative cellulose-based material made on the paper-making machine, wherein the comparative cellulose-based material having the basis weight and lacking the dry strength chemistry preparation. In an embodiment, the greater SCT is observed at a dry relative humidity. In an embodiment, the greater SCT is observed at a high relative humidity.

In an embodiment, the SCT is greater than a comparative SCT for a comparative cellulose-based material made on the paper-making machine, wherein the comparative cellulose-based material having the basis weight and lacking the wet strength chemistry preparation. In an embodiment, the greater SCT is observed at a dry relative humidity. In an embodiment, the greater SCT is observed at a high relative humidity.

In an embodiment, the dry strength chemistry preparation and the wet strength chemistry preparation provide a synergistic increase in SCT for the cellulose-based material in comparison to the comparative cellulose-based material. In an embodiment, the synergistic increase in SCT is observed at a dry relative humidity. In an embodiment, the synergistic increase in SCT is observed at a high relative humidity. The synergistic increase in SCT for the cellulose-based materials of the present disclosure is demonstrated in the subsequent examples and was unexpected.

In an embodiment, the cellulose-based material has a basis weight and short-span compression strength index (SCT Index). Generally, determining the SCT Index of a cellulose-based material is well known in the art by dividing the average SCT value of the cellulose-based material by the average basis weight of the cellulose-based material. In an embodiment, the SCT Index is greater than a comparative SCT Index for a comparative cellulose-based material made on the paper-making machine, wherein the comparative cellulose-based material having the basis weight and lacking the dry strength chemistry preparation and the wet strength chemistry preparation. In an embodiment, the greater SCT Index is observed at a dry relative humidity. In an embodiment, the greater SCT Index is observed at a high relative humidity.

In an embodiment, the SCT Index is greater than a comparative SCT Index for a comparative cellulose-based material made on the paper-making machine, wherein the comparative cellulose-based material having the basis weight and lacking the dry strength chemistry preparation. In an embodiment, the greater SCT Index is observed at a dry relative humidity. In an embodiment, the greater SCT Index is observed at a high relative humidity.

In an embodiment, the SCT Index is greater than a comparative SCT Index for a comparative cellulose-based material made on the paper-making machine, wherein the comparative cellulose-based material having the basis weight and lacking the wet strength chemistry preparation. In an embodiment, the greater SCT Index is observed at a dry relative humidity. In an embodiment, the greater SCT Index is observed at a high relative humidity.

In an embodiment, the dry strength chemistry preparation and the wet strength chemistry preparation provide a synergistic increase in SCT Index for the cellulose-based material in comparison to the comparative cellulose-based material. In an embodiment, the synergistic increase in SCT Index is observed at a dry relative humidity. In an embodiment, the synergistic increase in SCT Index is observed at a high relative humidity. The synergistic increase in SCT Index for the cellulose-based materials of the present disclosure is demonstrated in the subsequent examples and was unexpected.

In an embodiment, the cellulose-based material has a basis weight and a Concora value. Means of evaluating flat crush of a cellulose-based material via Concora are well known in the art. In an embodiment, the Concora value is greater than a comparative Concora value for a comparative cellulose-based material made on the paper-making machine, wherein the comparative cellulose-based material having the basis weight and lacking the dry strength chemistry preparation and the wet strength chemistry preparation. In an embodiment, the greater Concora value is observed at a dry relative humidity. In an embodiment, the greater Concora value is observed at a high relative humidity.

In an embodiment, the Concora value is greater than a comparative Concora value for a comparative cellulose-based material made on the paper-making machine, wherein the comparative cellulose-based material having the basis weight and lacking the dry strength chemistry preparation. In an embodiment, the greater Concora value is observed at a dry relative humidity. In an embodiment, the greater Concora value is observed at a high relative humidity.

In an embodiment, the Concora value is greater than a comparative Concora value for a comparative cellulose-based material made on the paper-making machine, wherein the comparative cellulose-based material having the basis weight and lacking the wet strength chemistry preparation. In an embodiment, the greater Concora value is observed at a dry relative humidity. In an embodiment, the greater Concora value is observed at a high relative humidity.

In an embodiment, the dry strength chemistry preparation and the wet strength chemistry preparation provide a synergistic increase in Concora value for the cellulose-based material in comparison to the comparative cellulose-based material. In an embodiment, the synergistic increase in Concora value is observed at a dry relative humidity. In an embodiment, the synergistic increase in Concora value is observed at a high relative humidity. The synergistic increase in Concora value for the cellulose-based materials of the present disclosure is demonstrated in the subsequent examples and was unexpected.

The containers made by the process of the present disclosure may be determined to have certain properties. For example, the containers can comprise a cellulose-based material having a basis weight. A basis weight is generally understood in the paper making arts to represent the mass per unit of area of the cellulose-based materials. For instance, the containers of the present disclosure can be contrasted to comparative containers comprising cellulose-based materials having a similar basis weight in which the comparative cellulose-based materials lack the wet strength chemistry preparation, lack the dry strength chemistry preparation, or lack both the wet strength chemistry preparation and the dry strength chemistry preparation.

In an embodiment, the container has a box compression strength (BCT50) measured at 50% relative humidity. In an embodiment, the BCT50 is greater than a comparative box compression strength (CBCT50) measured at 50% relative humidity of a comparative container comprising comparative cellulose-based material made on the paper machine at the basis weight and lacking the dry strength chemistry preparation and the wet strength chemistry preparation. In an embodiment, the BCT50 is greater than a CBCT50 measured at 50% relative humidity of a comparative container comprising comparative cellulose-based material made on the paper machine at the basis weight and lacking the dry strength chemistry preparation. In an embodiment, the BCT50 is greater than a comparative box compression strength CBCT50 measured at 50% relative humidity of a comparative container comprising comparative cellulose-based material made on the paper machine at the basis weight and lacking the wet strength chemistry preparation. In an embodiment, the dry strength chemistry preparation and the wet strength chemistry preparation provide a synergistic increase in BCT50 for the container in comparison to the comparative container. The synergistic increase in BCT50 for the containers of the present disclosure is demonstrated in the subsequent examples and was unexpected.

In an embodiment, the container has a box compression strength (BCT85) measured at 85% relative humidity. In an embodiment, the BCT85 is greater than a comparative box compression strength (CBCT85) measured at 85% relative humidity of a comparative container comprising comparative cellulose-based material made on the paper machine at the basis weight and lacking the dry strength chemistry preparation and the wet strength chemistry preparation. In an embodiment, the BCT85 is greater than a CBCT85 measured at 85% relative humidity of a comparative container comprising comparative cellulose-based material made on the paper machine at the basis weight and lacking the dry strength chemistry preparation. In an embodiment, the BCT85 is greater than a comparative box compression strength CBCT85 measured at 85% relative humidity of a comparative container comprising comparative cellulose-based material made on the paper machine at the basis weight and lacking the wet strength chemistry preparation. In an embodiment, the dry strength chemistry preparation and the wet strength chemistry preparation provide a synergistic increase in BCT85 for the container in comparison to the comparative container. The synergistic increase in BCT85 for the containers of the present disclosure is demonstrated in the subsequent examples and was unexpected.

The following numbered embodiments are contemplated and are non-limiting:

1. A process for making a cellulose-based material, the process comprising the step of treating cellulosic fibers with i) a dry strength chemistry preparation and ii) a wet strength chemistry preparation in a paper-making machine to provide the cellulose-based material.

2. The process of clause 1, any other suitable clause, or any combination of suitable clauses, wherein the cellulose-based material is a paper-based material.

3. The process of clause 1, any other suitable clause, or any combination of suitable clauses, wherein the cellulose-based material is paper.

4. The process of clause 1, any other suitable clause, or any combination of suitable clauses, wherein the cellulose-based material is a paper board.

5. The process of clause 1, any other suitable clause, or any combination of suitable clauses, wherein the cellulose-based material is a medium.

6. The process of clause 1, any other suitable clause, or any combination of suitable clauses, wherein the cellulose-based material is a liner.

7. The process of clause 1, any other suitable clause, or any combination of suitable clauses, wherein the cellulose-based material is a containerboard.

8. The process of clause 1, any other suitable clause, or any combination of suitable clauses, wherein the cellulose-based material is recyclable.

9. The process of clause 1, any other suitable clause, or any combination of suitable clauses, wherein the cellulosic fibers comprise virgin fibers.

10. The process of clause 1, any other suitable clause, or any combination of suitable clauses, wherein the cellulosic fibers comprise recycled fibers.

11. The process of clause 1, any other suitable clause, or any combination of suitable clauses, wherein the cellulosic fibers comprise a combination of virgin fibers and recycled fibers.

12. The process of clause 1, any other suitable clause, or any combination of suitable clauses, wherein the cellulosic fibers are capable of being recycled.

13. The process of clause 1, any other suitable clause, or any combination of suitable clauses, wherein the cellulose-based material is capable of being recycled.

14. The process of clause 1, any other suitable clause, or any combination of suitable clauses, wherein the dry strength chemistry preparation comprises an aldehyde functionalized polymer.

15. The process of clause 1, any other suitable clause, or any combination of suitable clauses, wherein the dry strength chemistry preparation comprises glyoxalated polyacrylamide (GPAM).

16. The process of clause 15, any other suitable clause, or any combination of suitable clauses, wherein the GPAM is applied to the cellulosic fibers between 1-16 dry lbs/ton.

17. The process of clause 15, any other suitable clause, or any combination of suitable clauses, wherein the GPAM is applied to the cellulosic fibers between 2-8 dry lbs/ton.

18. The process of clause 15, any other suitable clause, or any combination of suitable clauses, wherein the GPAM is applied to the cellulosic fibers at 2 dry lbs/ton.

19. The process of clause 15, any other suitable clause, or any combination of suitable clauses, wherein the GPAM is applied to the cellulosic fibers at 4 dry lbs/ton.

20. The process of clause 15, any other suitable clause, or any combination of suitable clauses, wherein the GPAM is applied to the cellulosic fibers at 6 dry lbs/ton.

21. The process of clause 15, any other suitable clause, or any combination of suitable clauses, wherein the GPAM is applied to the cellulosic fibers at 8 dry lbs/ton.

22. The process of clause 1, any other suitable clause, or any combination of suitable clauses, wherein the wet strength chemistry preparation comprises a polyamide resin.

23. The process of clause 22, any other suitable clause, or any combination of suitable clauses, wherein the polyamide resin is a polyamidoamine epihalohydrin resin.

24. The process of clause 22, any other suitable clause, or any combination of suitable clauses, wherein the polyamide resin is selected from the group consisting of EPI-Polyamide resin, Polyamide-Epichlorohydrin resin (PAE), and Epichlorohydrin polyamide resin.

25. The process of clause 22, any other suitable clause, or any combination of suitable clauses, wherein the polyamide resin is Polyamide-Epichlorohydrin resin (PAE).

26. The process of clause 22, any other suitable clause, or any combination of suitable clauses, The process of clause 22, any other suitable clause, or any combination of suitable clauses, wherein the polyamide resin is applied to the cellulosic fibers between 1-32 dry lbs/ton.

27. The process of clause 22, any other suitable clause, or any combination of suitable clauses, wherein the polyamide resin is applied to the cellulosic fibers between 2-16 dry lbs/ton.

28. The process of clause 22, any other suitable clause, or any combination of suitable clauses, wherein the polyamide resin is applied to the cellulosic fibers between 2-8 dry lbs/ton.

29. The process of clause 22, any other suitable clause, or any combination of suitable clauses, wherein the polyamide resin is applied to the cellulosic fibers at 2 dry lbs/ton.

30. The process of clause 22, any other suitable clause, or any combination of suitable clauses, wherein the polyamide resin is applied to the cellulosic fibers at 4 dry lbs/ton.

31. The process of clause 22, any other suitable clause, or any combination of suitable clauses, wherein the polyamide resin is applied to the cellulosic fibers at 6 dry lbs/ton.

32. The process of clause 22, any other suitable clause, or any combination of suitable clauses, wherein the polyamide resin is applied to the cellulosic fibers at 8 dry lbs/ton.

33. The process of clause 1, any other suitable clause, or any combination of suitable clauses, wherein the process further comprises a step of treating cellulosic fibers with a sizing agent.

34. The process of clause 33, any other suitable clause, or any combination of suitable clauses, wherein the sizing agent is an internal sizing agent.

35. The process of clause 33, any other suitable clause, or any combination of suitable clauses, wherein the sizing agent is a surface sizing agent.

36. The process of clause 33, any other suitable clause, or any combination of suitable clauses, wherein the sizing agent is alkenyl succinic anhydride (ASA).

37. The process of clause 33, any other suitable clause, or any combination of suitable clauses, wherein the sizing agent is rosin.

38. The process of clause 33, any other suitable clause, or any combination of suitable clauses, wherein the sizing agent is alkyl ketene dimer (AKD).

39. The process of clause 1, any other suitable clause, or any combination of suitable clauses, wherein the cellulosic fibers are treated with the dry strength chemistry preparation and the wet strength chemistry preparation at the same time.

40. The process of clause 1, any other suitable clause, or any combination of suitable clauses, wherein the cellulosic fibers are treated with the dry strength chemistry preparation and the wet strength chemistry preparation sequentially.

41. The process of clause 1, any other suitable clause, or any combination of suitable clauses, wherein the cellulosic fibers are treated with the dry strength chemistry preparation and the wet strength chemistry preparation separately.

42. The process of clause 1, any other suitable clause, or any combination of suitable clauses, wherein the dry strength chemistry preparation and the wet strength chemistry preparation are combined prior to treating the cellulosic fibers.

43. The process of clause 1, any other suitable clause, or any combination of suitable clauses, wherein the process further comprises treating cellulosic fibers with an enzymatic preparation.

44. The process of clause 43, any other suitable clause, or any combination of suitable clauses, wherein the enzymatic preparation comprises a polypeptide having amylase activity.

45. The process of clause 1, any other suitable clause, or any combination of suitable clauses, wherein the process does not comprise treating cellulosic fibers with an enzymatic preparation.

46. The process of clause 1, any other suitable clause, or any combination of suitable clauses, wherein the process further comprises treating cellulosic fibers with an anionic surface preparation.

47. The process of clause 46, any other suitable clause, or any combination of suitable clauses, wherein the anionic surface preparation is an anionic polyacrylamide.

48. The process of clause 46, any other suitable clause, or any combination of suitable clauses, wherein the anionic surface preparation is a copolymer of acrylamide and unsaturated carboxylic acid monomers, being (meth)acrylic acid, maleic acid, crotonic acid, itaconic acid, or any combination thereof.

49. The process of clause 1, any other suitable clause, or any combination of suitable clauses, wherein the process does not comprise treating cellulosic fibers with an anionic surface preparation.

50. The process of clause 1, any other suitable clause, or any combination of suitable clauses, wherein the cellulose-based material has a basis weight and a short-span compression strength (SCT).

51. The process of clause 50, any other suitable clause, or any combination of suitable clauses, wherein the SCT is greater than a comparative SCT for a comparative cellulose-based material made on the paper-making machine, wherein the comparative cellulose-based material having the basis weight and lacking the dry strength chemistry preparation and the wet strength chemistry preparation.

52. The process of clause 51, any other suitable clause, or any combination of suitable clauses, wherein the greater SCT is observed at a dry relative humidity.

53. The process of clause 51, any other suitable clause, or any combination of suitable clauses, wherein the greater SCT is observed at a high relative humidity.

54. The process of clause 50, any other suitable clause, or any combination of suitable clauses, wherein the SCT is greater than a comparative SCT for a comparative cellulose-based material made on the paper-making machine, wherein the comparative cellulose-based material having the basis weight and lacking the dry strength chemistry preparation.

55. The process of clause 54, any other suitable clause, or any combination of suitable clauses, wherein the greater SCT is observed at a dry relative humidity.

56. The process of clause 54, any other suitable clause, or any combination of suitable clauses, wherein the greater SCT is observed at a high relative humidity.

57. The process of clause 50, any other suitable clause, or any combination of suitable clauses, wherein the SCT is greater than a comparative SCT for a comparative cellulose-based material made on the paper-making machine, wherein the comparative cellulose-based material having the basis weight and lacking the wet strength chemistry preparation.

58. The process of clause 57, any other suitable clause, or any combination of suitable clauses, wherein the greater SCT is observed at a dry relative humidity.

59. The process of clause 57, any other suitable clause, or any combination of suitable clauses, wherein the greater SCT is observed at a high relative humidity.

60. The process of clause 50, any other suitable clause, or any combination of suitable clauses, wherein the dry strength chemistry preparation and the wet strength chemistry preparation provide a synergistic increase in SCT for the cellulose-based material in comparison to the comparative cellulose-based material.

61. The process of clause 60, any other suitable clause, or any combination of suitable clauses, wherein the synergistic increase in SCT is observed at a dry relative humidity.

62. The process of clause 60, any other suitable clause, or any combination of suitable clauses, wherein the synergistic increase in SCT is observed at a high relative humidity.

63. The process of clause 1, any other suitable clause, or any combination of suitable clauses, wherein the cellulose-based material has a basis weight and a short-span compression strength index (SCT Index).

64. The process of clause 63, any other suitable clause, or any combination of suitable clauses, wherein the SCT Index is greater than a comparative SCT Index for a comparative cellulose-based material made on the paper-making machine, wherein the comparative cellulose-based material having the basis weight and lacking the dry strength chemistry preparation and the wet strength chemistry preparation.

65. The process of clause 64, any other suitable clause, or any combination of suitable clauses, wherein the greater SCT Index is observed at a dry relative humidity.

66. The process of clause 64, any other suitable clause, or any combination of suitable clauses, wherein the greater SCT Index is observed at a high relative humidity.

67. The process of clause 63, any other suitable clause, or any combination of suitable clauses, wherein the SCT Index is greater than a comparative SCT Index for a comparative cellulose-based material made on the paper-making machine, wherein the comparative cellulose-based material having the basis weight and lacking the dry strength chemistry preparation.

68. The process of clause 67, any other suitable clause, or any combination of suitable clauses, wherein the greater SCT Index is observed at a dry relative humidity.

69. The process of clause 67, any other suitable clause, or any combination of suitable clauses, wherein the greater SCT Index is observed at a high relative humidity. 70. The process of clause 63, any other suitable clause, or any combination of suitable clauses, wherein the SCT Index is greater than a comparative SCT Index for a comparative cellulose-based material made on the paper-making machine, wherein the comparative cellulose-based material having the basis weight and lacking the wet strength chemistry preparation.

71. The process of clause 70, any other suitable clause, or any combination of suitable clauses, wherein the greater SCT Index is observed at a dry relative humidity.

72. The process of clause 70, any other suitable clause, or any combination of suitable clauses, wherein the greater SCT Index is observed at a high relative humidity.

73. The process of clause 63, any other suitable clause, or any combination of suitable clauses, wherein the dry strength chemistry preparation and the wet strength chemistry preparation provide a synergistic increase in SCT Index for the cellulose-based material in comparison to the comparative cellulose-based material.

74. The process of clause 73, any other suitable clause, or any combination of suitable clauses, wherein the synergistic increase in SCT Index is observed at a dry relative humidity.

75. The process of clause 73, any other suitable clause, or any combination of suitable clauses, wherein the synergistic increase in SCT Index is observed at a high relative humidity.

76. The process of clause 1, any other suitable clause, or any combination of suitable clauses, wherein the cellulose-based material has a basis weight and a Concora value.

77. The process of clause 76, any other suitable clause, or any combination of suitable clauses, wherein the Concora value is greater than a comparative Concora value for a comparative cellulose-based material made on the paper-making machine, wherein the comparative cellulose-based material having the basis weight and lacking the dry strength chemistry preparation and the wet strength chemistry preparation.

78. The process of clause 77, any other suitable clause, or any combination of suitable clauses, wherein the greater Concora value is observed at a dry relative humidity.

79. The process of clause 77, any other suitable clause, or any combination of suitable clauses, wherein the greater Concora value is observed at a high relative humidity.

80. The process of clause 76, any other suitable clause, or any combination of suitable clauses, wherein the Concora value is greater than a comparative Concora value for a comparative cellulose-based material made on the paper-making machine, wherein the comparative cellulose-based material having the basis weight and lacking the dry strength chemistry preparation. 81. The process of clause 80, any other suitable clause, or any combination of suitable clauses, wherein the greater Concora value is observed at a dry relative humidity.

82. The process of clause 80, any other suitable clause, or any combination of suitable clauses, wherein the greater Concora value is observed at a high relative humidity.

83. The process of clause 76, any other suitable clause, or any combination of suitable clauses, wherein the Concora value is greater than a comparative Concora value for a comparative cellulose-based material made on the paper-making machine, wherein the comparative cellulose-based material having the basis weight and lacking the wet strength chemistry preparation.

84. The process of clause 83, any other suitable clause, or any combination of suitable clauses, wherein the greater Concora value is observed at a dry relative humidity.

85. The process of clause 83, any other suitable clause, or any combination of suitable clauses, wherein the greater Concora value is observed at a high relative humidity.

86. The process of clause 76, any other suitable clause, or any combination of suitable clauses, wherein the dry strength chemistry preparation and the wet strength chemistry preparation provide a synergistic increase in the Concora value for the cellulose-based material in comparison to the comparative cellulose-based material.

87. The process of clause 86, any other suitable clause, or any combination of suitable clauses, wherein the synergistic increase in the Concora value is observed at a dry relative humidity.

88. The process of clause 86, any other suitable clause, or any combination of suitable clauses, wherein the synergistic increase in the Concora value is observed at a high relative humidity.

89. A process for making a container, the process comprising the steps of treating cellulosic fibers with i) a dry strength chemistry preparation and ii) a wet strength chemistry preparation in a paper-making machine to provide a cellulose-based material forming a container blank using the cellulose-based material, and forming a container using the cellulose-based material.

90. The process of clause 89, any other suitable clause, or any combination of suitable clauses, wherein the cellulose-based material is recyclable.

91. The process of clause 89, any other suitable clause, or any combination of suitable clauses, wherein the container is corrugated cardboard 92. The process of clause 89, any other suitable clause, or any combination of suitable clauses, wherein the cellulosic fibers comprise virgin fibers.

93. The process of clause 89, any other suitable clause, or any combination of suitable clauses, wherein the cellulosic fibers comprise recycled fibers.

94. The process of clause 89, any other suitable clause, or any combination of suitable clauses, wherein the cellulosic fibers comprise a combination of virgin fibers and recycled fibers.

95. The process of clause 89, any other suitable clause, or any combination of suitable clauses, wherein the cellulosic fibers are capable of being recycled.

96. The process of clause 89, any other suitable clause, or any combination of suitable clauses, wherein the container is capable of being recycled.

97. The process of clause 89, any other suitable clause, or any combination of suitable clauses, wherein the dry strength chemistry preparation comprises an aldehyde functionalized polymer.

98. The process of clause 89, any other suitable clause, or any combination of suitable clauses, wherein the dry strength chemistry preparation comprises glyoxalated polyacrylamide (GPAM).

99. The process of clause 98, any other suitable clause, or any combination of suitable clauses, wherein the GPAM is applied to the cellulosic fibers between 1-16 dry lbs/ton.

100. The process of clause 98, any other suitable clause, or any combination of suitable clauses, wherein the GPAM is applied to the cellulosic fibers between 2-8 dry lbs/ton.

101. The process of clause 98, any other suitable clause, or any combination of suitable clauses, wherein the GPAM is applied to the cellulosic fibers at 2 dry lbs/ton.

102. The process of clause 98, any other suitable clause, or any combination of suitable clauses, wherein the GPAM is applied to the cellulosic fibers at 4 dry lbs/ton.

103. The process of clause 98, any other suitable clause, or any combination of suitable clauses, wherein the GPAM is applied to the cellulosic fibers at 6 dry lbs/ton.

104. The process of clause 98, any other suitable clause, or any combination of suitable clauses, wherein the GPAM is applied to the cellulosic fibers at 8 dry lbs/ton.

105. The process of clause 89, any other suitable clause, or any combination of suitable clauses, wherein the wet strength chemistry preparation comprises a polyamide resin.

106. The process of clause 105, any other suitable clause, or any combination of suitable clauses, wherein the polyamide resin is a polyamidoamine epihalohydrin resin.

107. The process of clause 105, any other suitable clause, or any combination of suitable clauses, wherein the polyamide resin is selected from the group consisting of EPI-Polyamide resin, Polyamide-Epichlorohydrin resin (PAE), and Epichlorohydrin polyamide resin.

108. The process of clause 105, any other suitable clause, or any combination of suitable clauses, wherein the polyamide resin is Polyamide-Epichlorohydrin resin (PAE).

109. The process of clause 105, any other suitable clause, or any combination of suitable clauses, wherein the polyamide resin is applied to the cellulosic fibers between 1-32 dry lbs/ton.

110. The process of clause 105, any other suitable clause, or any combination of suitable clauses, wherein the polyamide resin is applied to the cellulosic fibers between 2-16 dry lbs/ton.

111. The process of clause 105, any other suitable clause, or any combination of suitable clauses, wherein the polyamide resin is applied to the cellulosic fibers between 2-8 dry lbs/ton.

112. The process of clause 105, any other suitable clause, or any combination of suitable clauses, wherein the polyamide resin is applied to the cellulosic fibers at 2 dry lbs/ton.

113. The process of clause 105, any other suitable clause, or any combination of suitable clauses, wherein the polyamide resin is applied to the cellulosic fibers at 4 dry lbs/ton.

114. The process of clause 105, any other suitable clause, or any combination of suitable clauses, wherein the polyamide resin is applied to the cellulosic fibers at 6 dry lbs/ton.

115. The process of clause 105, any other suitable clause, or any combination of suitable clauses, wherein the polyamide resin is applied to the cellulosic fibers at 8 dry lbs/ton.

116. The process of clause 89, any other suitable clause, or any combination of suitable clauses, wherein the process further comprises a step of treating cellulosic fibers with a sizing agent.

117. The process of clause 116, any other suitable clause, or any combination of suitable clauses, wherein the sizing agent is an internal sizing agent.

118. The process of clause 116, any other suitable clause, or any combination of suitable clauses, wherein the sizing agent is a surface sizing agent.

119. The process of clause 116, any other suitable clause, or any combination of suitable clauses, wherein the sizing agent is alkenyl succinic anhydride (ASA).

120. The process of clause 116, any other suitable clause, or any combination of suitable clauses, wherein the sizing agent is rosin.

121. The process of clause 116, any other suitable clause, or any combination of suitable clauses, wherein the sizing agent is alkyl ketene dimer (AKD).

122. The process of clause 89, any other suitable clause, or any combination of suitable clauses, wherein the cellulosic fibers are treated with the dry strength chemistry preparation and the wet strength chemistry preparation at the same time.

123. The process of clause 89, any other suitable clause, or any combination of suitable clauses, wherein the cellulosic fibers are treated with the dry strength chemistry preparation and the wet strength chemistry preparation sequentially.

124. The process of clause 89, any other suitable clause, or any combination of suitable clauses, wherein the cellulosic fibers are treated with the dry strength chemistry preparation and the wet strength chemistry preparation separately.

125. The process of clause 89, any other suitable clause, or any combination of suitable clauses, wherein the dry strength chemistry preparation and the wet strength chemistry preparation are combined prior to treating the cellulosic fibers.

126. The process of clause 89, any other suitable clause, or any combination of suitable clauses, wherein the process further comprises treating cellulosic fibers with an enzymatic preparation.

127. The process of clause 126, any other suitable clause, or any combination of suitable clauses, wherein the enzymatic preparation comprises a polypeptide having amylase activity.

128. The process of clause 89, any other suitable clause, or any combination of suitable clauses, wherein the process does not comprise treating cellulosic fibers with an enzymatic preparation.

129. The process of clause 89, any other suitable clause, or any combination of suitable clauses, wherein the process further comprises treating cellulosic fibers with an anionic surface preparation.

130. The process of clause 129, any other suitable clause, or any combination of suitable clauses, wherein the anionic surface preparation is an anionic polyacrylamide.

131. The process of clause 129, any other suitable clause, or any combination of suitable clauses, wherein the anionic surface preparation is a copolymer of acrylamide and unsaturated carboxylic acid monomers, being (meth)acrylic acid, maleic acid, crotonic acid, itaconic acid, or any combination thereof.

132. The process of clause 89, any other suitable clause, or any combination of suitable clauses, wherein the process does not comprise treating cellulosic fibers with an anionic surface preparation.

133. The process of clause 89, any other suitable clause, or any combination of suitable clauses, wherein the container has a box compression strength (BCT50) measured at 50% relative humidity.

134. The process of clause 133, any other suitable clause, or any combination of suitable clauses, wherein the BCT50 is greater than a comparative box compression strength (CBCT50) measured at 50% relative humidity of a comparative container comprising comparative cellulose-based material made on the paper machine at the basis weight and lacking the dry strength chemistry preparation and the wet strength chemistry preparation.

135. The process of clause 133, any other suitable clause, or any combination of suitable clauses, wherein the BCT50 is greater than a comparative box compression strength (CBCT50) measured at 50% relative humidity of a comparative container comprising comparative cellulose-based material made on the paper machine at the basis weight and lacking the dry strength chemistry preparation.

136. The process of clause 133, any other suitable clause, or any combination of suitable clauses, wherein the BCT50 is greater than a comparative box compression strength (CBCT50) measured at 50% relative humidity of a comparative container comprising comparative cellulose-based material made on the paper machine at the basis weight and lacking the wet strength chemistry preparation.

137. The process of clause 133, any other suitable clause, or any combination of suitable clauses, wherein the dry strength chemistry preparation and the wet strength chemistry preparation provide a synergistic increase in BCT50 for the container in comparison to the comparative container.

138. The process of clause 89, any other suitable clause, or any combination of suitable clauses, wherein the container has a box compression strength (BCT85) measured at 85% relative humidity. 139. The process of clause 138, any other suitable clause, or any combination of suitable clauses, wherein the BCT85 is greater than a comparative box compression strength (CBCT85) measured at 85% relative humidity of a comparative container comprising comparative cellulose-based material made on the paper machine at the basis weight and lacking the dry strength chemistry preparation and the wet strength chemistry preparation.

140. The process of clause 138, any other suitable clause, or any combination of suitable clauses, wherein the BCT85 is greater than a comparative box compression strength (CBCT85) measured at 85% relative humidity of a comparative container comprising comparative cellulose-based material made on the paper machine at the basis weight and lacking the dry strength chemistry preparation.

141. The process of clause 138, any other suitable clause, or any combination of suitable clauses, wherein the BCT50 is greater than a comparative box compression strength (CBCT85) measured at 85% relative humidity of a comparative container comprising comparative cellulose-based material made on the paper machine at the basis weight and lacking the wet strength chemistry preparation.

142. The process of clause 138, any other suitable clause, or any combination of suitable clauses, wherein the dry strength chemistry preparation and the wet strength chemistry preparation provide a synergistic increase in BCT85 for the container in comparison to the comparative container.

EXAMPLES

Example 1

Paper Trial #1 [Mill A]

An exemplary cellulose-based material in accordance with certain aspects of the present disclosure is provided in the instant example. Evaluations in the instant example include short-span compression strength (SCT), SCT Index, and Concora values.

For the instant example, several different cellulose-based materials with a basis weight of 36 were prepared and compared. Preparation of the different cellulose-based materials included varying the basis weight of the material, the presence of a wet strength chemistry preparation, and the presence and amount of a dry strength chemistry preparation.

The various cellulose-based materials with a basis weight of 36 were compared to other cellulose-based materials with a basis weight of 40 or a basis weight of 45. The evaluations of the other cellulose-based materials (i.e., with a basis weight of 40 or a basis weight of 45) are based on average production runs at the mill for Paper Trial #1.

The characteristics of the different cellulose-based materials are presented in Table 1.

TABLE 1

| Material No. | Basis Weight | Wet Strength (dry lbs/ton) | Dry Strength (dry lbs/ton) |
|---|---|---|---|
| 1 | 36 | 8.5 | 0 |
| 2 | 36 | 4 | 4 |
| 3 | 36 | 4 | 8 |
| 4 | 40 | 0 | 0 |
| 5 | 40 | 3-4* | 0 |
| 6 | 45 | 0 | 0 |
| 7 | 45 | 3-4* | 0 |

*Average wet strength added; modified as wet strength concentrations stabilized in the system.

As an exemplary procedure, cellulose-based material can be produced using an aqueous slurry comprising cellulosic fibers. The general process for making cellulose-based material is well known in the art and can utilize starting materials such as trees, logs, and/or chips to provide the cellulosic fibers. Such starting materials are heated in a "defibering" method and the resultant cellulosic fibers are then further processed with water to form the aqueous slurry. The general process for making cellulose-based materials is described, for instance, in U.S. Pat. Nos. 7,648,772 and 7,682,486, both herein incorporated by reference in their entireties.

For instance, virgin fibers, recycled fibers (e.g., old corrugated containers, other recycled paper products, and the like), or combinations thereof can be used in the aqueous slurry. The aqueous slurry can also comprise, for example, water, mechanical fibers (e.g., NSSC), ash content, and other materials known in the art.

The wet strength chemistry preparation and the dry strength chemistry preparation are then added to the aqueous slurry. The wet strength chemistry preparation and the dry strength chemistry preparation can be added to the aqueous slurry separately or together and can also be added to the aqueous slurry in any order.

Following the combination of ingredients, the aqueous slurry is formed into a web and then dried to produce the cellulose-based material.

The cellulose-based materials were evaluated for SCT values according to the procedures of TAPPI 826, entitled "Short span compression strength of containerboard." The SCT evaluation can determine the edgewise compressive strength of cellulose-based materials such as paperboard with a span-to-thickness ratio of 5 or less (basis wt. 20 #/msf or greater.) A L&W 152 STFI Tester can be utilized as equipment for the SCT evaluation.

The cellulose-based materials were evaluated for SCT Index by calculating the average SCT value divided by the average weight of the sample (i.e., basis weight). For basis weight determinations, the procedures of TAPPI T 410, entitled "Grammage of paper and paperboard (weight per unit area)," were utilized. For instance, a Toledo Basis Weight Scale or Mettler analytical balance can be utilized as equipment for the basis weight evaluation.

The cellulose-based materials were evaluated for Concora values according to the procedures of TAPPI 809, entitled "Flat crush of corrugating medium (CMT Test)." Testing of flat crush resistance is necessary to prevent crushing the structure on the corrugator or finishing equipment, and Concora evaluation allows for testing prior to fabrication of board or containers from the cellulose-based materials. Concora evaluation is also utilized for determining fabrication efficiency.

A L&W SE 108 Sample Die Cutter, a fluter, and a L&W Crust Tester code 248 can be utilized as equipment for the Concora evaluation.

The evaluations and comparison of the different cellulose-based materials are presented in Table 2.

TABLE 2

| Material No. | Basis Weight | Wet Strength | Dry Strength | SCT | SCT Index | Concora |
|---|---|---|---|---|---|---|
| 1 | 36 | 8.5 | 0 | 19.4 | 0.545 | 65 |
| 2 | 36 | 4 | 4 | 21.1 | 0.596 | 80 |
| 3 | 36 | 4 | 8 | 22.0 | 0.621 | 88 |
| 4 | 40 | 0 | 0 | 19.8 | 0.508 | 66 |
| 5 | 40 | 3-4* | 0 | 21.2 | 0.530 | 77 |
| 6 | 45 | 0 | 0 | 23 | 0.526 | 71 |
| 7 | 45 | 3-4* | 0 | 22.9 | 0.515 | 82 |

*Average wet strength added; modified as wet strength concentrations stabilized in the system.

As shown in Table 2, the cellulose-based material in accordance with the present disclosure was superior than the comparison cellulose-based materials. First, inclusion of a dry strength chemistry preparation demonstrated an increase in SCT, SCT Index, and Concora values compared to other cellulose-based materials that did not include a dry strength chemistry preparation.

In the instant example, the cellulose-based material in accordance with the present disclosure, even when prepared using a lower basis weight, demonstrated superior or similar SCT, SCT Index, and Concora values compared to other cellulose-based materials prepared with a higher basis weight. Thus, cellulose-based material with a lower basis weight, when prepared in accordance with the present disclosure, performs better than comparative cellulose-based material with a higher basis weight. This improved performance provides an advantage in that cellulose-based material prepared in accordance with the present disclosure uses at least 10% less material to generate a product with desirable characteristics compared to traditional paper-making procedures.

Example 2

Paper Trial #2 [Mill B]

An exemplary cellulose-based material in accordance with certain aspects of the present disclosure is provided in the instant example. Evaluations in the instant example include short-span compression strength (SCT), SCT Index, and Concora values.

For the instant example, different cellulose-based materials with a basis weight of 36 were prepared and compared. Preparation of the different cellulose-based materials included varying the basis weight of the material, the presence of a wet strength chemistry preparation, and the presence and amount of a dry strength chemistry preparation.

The various cellulose-based materials with a basis weight of 36 were compared to other cellulose-based materials with a basis weight of 40 or a basis weight of 45. The evaluations of the other cellulose-based materials (i.e., with a basis weight of 40 or a basis weight of 45) are based on average production runs at a similar mill to Paper Trial #2.

The characteristics of the different cellulose-based materials are presented in Table 3.

TABLE 3

| Material No. | Basis Weight | Wet Strength (dry lbs/ton) | Dry Strength (dry lbs/ton) |
|---|---|---|---|
| 1 | 36 | 3.5 | 0 |
| 2 | 36 | 3.5 | 4 |
| 3 | 40 | 0 | 0 |
| 4 | 40 | 3-4* | 0 |
| 5 | 45 | 0 | 0 |
| 6 | 45 | 3-4* | 0 |

*Average wet strength added; modified as wet strength concentrations stabilized in the system.

The process for preparing the cellulose-based materials for the instant example were similar to those for Example 1. Further, the methods of evaluating SCT, SCT Index, and Concora values were identical to those in Example 1.

The evaluations and comparison of the different cellulose-based materials are presented in Table 4.

TABLE 4

| Material No. | Basis Weight | Wet Strength | Dry Strength | SCT | SCT Index | Concora |
|---|---|---|---|---|---|---|
| 1 | 36 | 3.5 | 0 | 19.6 | 0.554 | 68 |
| 2 | 36 | 3.5 | 4 | 21.9 | 0.617 | 70 |
| 3 | 40 | 0 | 0 | 19.8 | 0.508 | 66 |
| 4 | 40 | 3-4* | 0 | 21.2 | 0.530 | 77 |
| 5 | 45 | 0 | 0 | 23 | 0.526 | 71 |
| 6 | 45 | 3-4* | 0 | 22.9 | 0.515 | 82 |

*Average wet strength added; modified as wet strength concentrations stabilized in the system.

As shown in Table 4, the cellulose-based material in accordance with the present disclosure was superior than the comparison cellulose-based materials. First, inclusion of a dry strength chemistry preparation demonstrated an increase in SCT, SCT Index, and Concora values compared to other cellulose-based materials that did not include a dry strength chemistry preparation.

In the instant example, the cellulose-based material in accordance with the present disclosure, even when prepared using a lower basis weight, demonstrated superior or similar SCT, SCT Index, and Concora values compared to other cellulose-based materials prepared with a higher basis weight. Thus, cellulose-based material with a lower basis weight, when prepared in accordance with the present disclosure, performs better than comparative cellulose-based material with a higher basis weight. This improved performance provides an advantage in that cellulose-based material prepared in accordance with the present disclosure uses at least 10% less material to generate a product with desirable characteristics compared to traditional paper-making procedures.

Example 3

Paper Trial #3 [Mill C]

An exemplary cellulose-based material in accordance with certain aspects of the present disclosure is provided in the instant example. Evaluations in the instant example include short-span compression strength (SCT), SCT Index, and Concora values.

For the instant example, several different cellulose-based materials with a basis weight of 36 were prepared and compared. Preparation of the different cellulose-based materials included varying the basis weight of the material, the presence of a wet strength chemistry preparation, and the presence and amount of a dry strength chemistry preparation.

The various cellulose-based materials with a basis weight of 36 were compared to other cellulose-based materials with a basis weight of 40 or a basis weight of 45. The evaluations of the other cellulose-based materials (i.e., with a basis weight of 40 or a basis weight of 45) are based on average production runs at the mill for Paper Trial #3.

The characteristics of the different cellulose-based materials are presented in Table 5.

TABLE 5

| Material No. | Basis Weight | Wet Strength (dry lbs/ton) | Dry Strength (dry lbs/ton) |
|---|---|---|---|
| 1 | 36 | 3.2 | 0 |
| 2 | 36 | 3.2 | 4 |
| 3 | 36 | 3.2 | 8 |
| 4 | 40 | 0 | 0 |
| 5 | 40 | 3-4* | 0 |
| 6 | 45 | 0 | 0 |
| 7 | 45 | 3-4* | 0 |

*Average wet strength added; modified as wet strength concentrations stabilized in the system.

The process for preparing the cellulose-based materials for the instant example were similar to those for Example 1. Further, the methods of evaluating SCT, SCT Index, and Concora values were identical to those in Example 1.

The evaluations and comparison of the different cellulose-based materials are presented in Table 6.

TABLE 6

| Material No. | Basis Weight | Wet Strength | Dry Strength | SCT | SCT Index | Concora |
|---|---|---|---|---|---|---|
| 1 | 36 | 3.2 | 0 | 19.5 | 0.559 | 65 |
| 2 | 36 | 3.2 | 4 | 21.2 | 0.592 | 73 |
| 3 | 36 | 3.2 | 8 | 22.5 | 0.628 | 76 |
| 4 | 40 | 0 | 0 | 20.4 | 0.523 | 74 |

TABLE 6-continued

| Material No. | Basis Weight | Wet Strength | Dry Strength | SCT | SCT Index | Concora |
|---|---|---|---|---|---|---|
| 5 | 40 | 3-4* | 0 | 20.6 | 0.521 | 78.5 |
| 6 | 45 | 0 | 0 | 23.5 | 0.533 | 77 |
| 7 | 45 | 3-4* | 0 | 24.3 | 0.546 | 84 |

*Average wet strength added; modified as wet strength concentrations stabilized in the system.

As shown in Table 6, the cellulose-based material in accordance with the present disclosure was superior than the comparison cellulose-based materials. First, inclusion of a dry strength chemistry preparation demonstrated an increase in SCT, SCT Index, and Concora values compared to other cellulose-based materials that did not include a dry strength chemistry preparation.

In the instant example, the cellulose-based material in accordance with the present disclosure, even when prepared using a lower basis weight, demonstrated superior or similar SCT, SCT Index, and Concora values compared to other cellulose-based materials prepared with a higher basis weight. Thus, cellulose-based material with a lower basis weight, when prepared in accordance with the present disclosure, performs better than comparative cellulose-based material with a higher basis weight. This improved performance provides an advantage in that cellulose-based material prepared in accordance with the present disclosure uses at least 10% less material to generate a product with desirable characteristics compared to traditional paper-making procedures.

Example 4

Paper Trial #4 [Mill B]

An exemplary cellulose-based material in accordance with certain aspects of the present disclosure is provided in the instant example. Evaluations in the instant example include short-span compression strength (SCT), SCT Index, and Concora values.

For the instant example, several different cellulose-based materials with a basis weight of 23 were prepared and compared. Preparation of the different cellulose-based materials included varying the basis weight of the material, the presence of a wet strength chemistry preparation, and the presence and amount of a dry strength chemistry preparation.

The various cellulose-based materials with a basis weight of 23 were compared to other cellulose-based materials with a basis weight of 26 or a basis weight of 30. The evaluations of the other cellulose-based materials (i.e., with a basis weight of 26 or a basis weight of 30) are based on average production runs at the mill for Paper Trial #4.

The characteristics of the different cellulose-based materials are presented in Table 7.

TABLE 7

| Material No. | Basis Weight | Wet Strength (dry lbs/ton) | Dry Strength (dry lbs/ton) |
|---|---|---|---|
| 1 | 23 | 4 | 0 |
| 2 | 23 | 4 | 2 |
| 3 | 23 | 4 | 4 |
| 4 | 23 | 4 | 8 |
| 5 | 26 | 0 | 0 |
| 6 | 30 | 0 | 0 |

The process for preparing the cellulose-based materials for the instant example were similar to those for Example 1. Further, the methods of evaluating SCT, SCT Index, and Concora values were identical to those in Example 1.

The evaluations and comparison of the different cellulose-based materials are presented in Table 8.

TABLE 8

| Material No. | Basis Weight | Wet Strength | Dry Strength | SCT | SCT Index | Concora |
|---|---|---|---|---|---|---|
| 1 | 23 | 4 | 0 | 13.4 | 0.561 | 45 |
| 2 | 23 | 4 | 2 | 14.2 | 0.592 | 51 |
| 3 | 23 | 4 | 4 | 13.9 | 0.580 | 53 |
| 4 | 23 | 4 | 8 | 16.0 | 0.661 | 54 |
| 5 | 26 | 0 | 0 | 12.9 | 0.520 | 48 |
| 6 | 30 | 0 | 0 | 15.0 | 0.521 | 56 |

As shown in Table 8, the cellulose-based material in accordance with the present disclosure was superior than the comparison cellulose-based materials. First, inclusion of a dry strength chemistry preparation demonstrated an increase in SCT, SCT Index, and Concora values compared to other cellulose-based materials that did not include a dry strength chemistry preparation.

In the instant example, the cellulose-based material in accordance with the present disclosure, even when prepared using a lower basis weight, demonstrated superior or similar SCT, SCT Index, and Concora values compared to other cellulose-based materials prepared with a higher basis weight. Thus, cellulose-based material with a lower basis weight, when prepared in accordance with the present disclosure, performs better than comparative cellulose-based material with a higher basis weight. This improved performance provides an advantage in that cellulose-based material prepared in accordance with the present disclosure uses at least 10% less material to generate a product with desirable characteristics compared to traditional paper-making procedures.

Example 5

Container Trial #1 [Plant D]

An exemplary container in accordance with certain aspects of the present disclosure is provided in the instant example. Evaluations in the instant example include box compression strength measured at 50% relative humidity (BCT50) and box compression strength measured at 85% relative humidity (BCT85).

For the instant example, different containers were prepared using various cellulose-based materials and then compared. Preparation of the containers comprised different cellulose-based materials that varied the basis weight of the material and the presence and amount of a dry strength chemistry preparation.

The same liner rolls (56 lb liner) were utilized for each container from the various mill containers.

The characteristics of the different containers are presented in Table 9.

TABLE 9

| Container No. | Identifier | Basis Weight | Wet Strength (dry lbs/ton) | Dry Strength (dry lbs/ton) |
|---|---|---|---|---|
| 1 | Reg CG 36 [Plant B] | 36 | 3.5 | 0 |
| 2 | CG 2.0 36 [Plant B] | 36 | 3.5 | 4 |
| 3 | Reg CG 36 [Plant C] | 36 | 3.2 | 0 |
| 4 | CG 2.0 36 [Plant C] | 36 | 3.2 | 4 |
| 5 | Reg CG 23 [Plant B] | 23 | 4 | 0 |
| 6 | CG 2.0 23 [Plant B] | 23 | 4 | 4 |

Using the various cellulose-based materials, a Corrugator can be used to produce corrugated sheets. A Corrugator can range from about 250 to about 400 feet long with a width range from about 67 inches to about 132 inches. Typical Corrugators can include a Single Facer section wherein the top liner can be adjoined with starch to a medium that has been corrugated via corrugating rolls. Corrugators are known to the skilled artisan and can include, for example, those manufactured by United, BHS, MHI, Fosber, and the like.

The second side liner can then be adhered using starch to the single face sheet in a "Doublefacer" or "Doublebacker" apparatus. The resultant combined board sheet can then be cut into specified widths and can be scored for folding in the container-making process. A cutoff knife can be used to cut the container to the desired length. Typically, a Corrugator can operate at a speed from about 600 to about 1200 feet per minute (fpm) and can be varied according to the general knowledge in the art.

Thereafter, combined board sheets can then be processed through a primary finishing process, depending on the desired end use. For instance, a Flexo Folder Gluer finishing process or Die Cutting equipment could be utilized. A Flexo Folder Gluer can include a feed section, print section, slotter-scorer, and a folder gluer section. A die cutter can be, for example, rotary or platen (flatbed) and produces slotted carton containers that are typically not glued.

The cellulose-based materials can be evaluated for BCT50 values according to the procedures of TAPPI T-804 om-06, entitled "Compression Test of Fiberboard Shipping Containers." The containers can be conditioned at a temperature of 73° F. and 50% relative humidity for the BCT50 evaluation, as it is important to provide uniform moisture content for the testing (see T402, entitled "Standard conditioning and testing atmospheres for paper, board, pulp hand sheets, and related products").

First, the containers can be subjected to preconditioning in a preconditioning chamber. Temperature and humidity preconditioning can be performed overnight or for at least 2 hours (e.g., liner, medium, bag, or other cellulose-based materials), at least 7 hours (e.g., corrugated board, solid fiber, or open containers), at least 14 hours (e.g., sealed containers), or 72 hours (e.g., vapor resistant (waxed) board and containers).

Thereafter, containers are removed from the preconditioning chamber and placed into conditioning. Temperature and humidity conditioning can be performed overnight or for at least 4 hours (e.g., liner, medium, bag, or other cellulose-based materials), at least 8 hours (e.g., corrugated board, solid fiber, or open containers), at least 16 hours (e.g., sealed containers), or 72 hours (e.g., vapor resistant (waxed) board and containers).

The BCT50 evaluation can measure the ability of containers, such as corrugated or solid fiber shipping containers, to resist external compressive forces. A higher BCT50 value is desirable because external compressive forces may be encountered in stacking the containers or in transporting the containers.

An Emerson Tester Model 6210 and/or an Emerson Model 8510 can be utilized as compression tester equipment for the BCT50 evaluation. The container can be placed at the center of the bottom platen of the compression tester. Then, a preload can be applied to the container, for instance 50 pounds on a singlewall container, 100 pounds on a doublewall container, or 500 pounds on bulk bins. The load can continue to be applied to the container at the rate of 0.5 inches (13+/−2.5 mm) until failure occurs, as evidenced by one or both of i) falling back from maximum load of 25% or ii) deflection exceeding 0.75 inches or greater. Thereafter, the maximum compression and deflection or the compression at the specified deflection can be recorded for the evaluated container.

BCT85 evaluations are conducted in a similar manner as the BCT50 evaluations, except that the containers can be conditioned at a temperature of 40° F. and 85% relative humidity prior to compression testing.

The evaluations and comparison of the containers prepared with different cellulose-based materials are presented in Table 10.

TABLE 10

| Container No. | Basis Weight | Wet Strength | Dry Strength | BCT50 | BCT85 |
|---|---|---|---|---|---|
| 1 | 36 | 3.5 | 0 | 1009 | 549 |
| 2 | 36 | 3.5 | 4 | 1102 | 642 |
| 3 | 36 | 3.2 | 0 | 1076 | 586 |
| 4 | 36 | 3.2 | 4 | 1006 | 636 |
| 5 | 23 | 4 | 0 | 501 | 317 |
| 6 | 23 | 4 | 4 | 547 | 345 |

As shown in Table 10, the containers in accordance with the present disclosure were superior than the comparison containers. Inclusion of a dry strength chemistry preparation in the cellulose-based materials that prepared the containers demonstrated an increase in BCT50 and BCT85 values compared to the comparison containers made with cellulose-based materials that did not include a dry strength chemistry preparation.

Example 6

Container Trial #2 [Plant A]

An exemplary container in accordance with certain aspects of the present disclosure is provided in the instant example. Evaluations in the instant example include short-span compression strength (SCT), SCT Index, box compression strength measured at 50% relative humidity (BCT50) and box compression strength measured at 85% relative humidity (BCT85).

For the instant example, different containers were prepared using various cellulose-based materials and then compared. Preparation of the containers comprised different cellulose-based materials that varied the basis weight of the material and the presence and amount of a dry strength chemistry preparation. The process for preparing the containers for the instant example were similar to those for Example 5.

The characteristics of the different containers are presented in Table 11.

TABLE 11

| Container No. | Basis Weight | Wet Strength (dry lbs/ton) | Dry Strength (dry lbs/ton) |
|---|---|---|---|
| 1 | 35.63 | 8.5 | 0 |
| 2 | 35.40 | 4 | 4 |
| 3 | 35.40 | 4 | 8 |

The evaluations and comparison of the containers prepared with different cellulose-based materials are presented in Table 12.

TABLE 12

| Container No. | Basis Weight | Wet Strength | Dry Strength | SCT (lbf/in) | SCT Index (SCT/BW) | BCT50 | BCT85 | BCT % Loss |
|---|---|---|---|---|---|---|---|---|
| 1 | 35.63 | 8.5 | 0 | 19.4 | 0.54 | 987.6 | 753.2 | 23.7 |
| 2 | 35.40 | 4 | 4 | 21.0 | 0.59 | 1037.7 | 882.2 | 15.0 |
| 3 | 35.40 | 4 | 8 | 22.0 | 0.62 | 1080.9 | 908.4 | 16.0 |

As shown in Table 12, the containers in accordance with the present disclosure were superior than the comparison containers. Inclusion of a dry strength chemistry preparation in the cellulose-based materials that prepared the containers demonstrated an increase in SCT and SCT Index values compared to the comparison containers made with cellulose-based materials that did not include a dry strength chemistry preparation. Furthermore, inclusion of a dry strength chemistry preparation in the cellulose-based materials that prepared the containers demonstrated an increase in BCT50 and BCT85 values compared to the comparison containers made with cellulose-based materials that did not include a dry strength chemistry preparation.

Example 7

Container Trial #3 [Plant C]

An exemplary container in accordance with certain aspects of the present disclosure is provided in the instant example. Evaluations in the instant example include short-span compression strength (SCT), SCT Index, box compression strength measured at 50% relative humidity (BCT50), and box compression strength measured at 85% relative humidity (BCT85).

For the instant example, different containers were prepared using various cellulose-based materials and then compared. Preparation of the containers comprised different cellulose-based materials that varied the basis weight of the material and the presence and amount of a dry strength chemistry preparation. The process for preparing the containers for the instant example were similar to those for Example 5.

The characteristics of the different containers are presented in Table 13.

TABLE 13

| Container No. | Basis Weight | Wet Strength (dry lbs/ton) | Dry Strength (dry lbs/ton) |
|---|---|---|---|
| 1 | 34.4 | 0 | 0 |
| 2 | 34.9 | 3.2 | 0 |
| 3 | 35.8 | 3.2 | 4 |
| 4 | 34.9 | 3.2 | 8 |

The process for preparing the containers for the instant example were similar to those for Example 6. Further, the methods of evaluating SCT, SCT Index, BCT50, and BCT85 values were identical to those in Example 6.

The evaluations and comparison of the containers prepared with different cellulose-based materials are presented in Table 14.

TABLE 14

| Container No. | Basis Weight | Wet Strength | Dry Strength | SCT (lbf/in) | SCT Index (SCT/BW) | BCT50 | BCT85 | BCT % Loss |
|---|---|---|---|---|---|---|---|---|
| 1 | 34.4 | 0 | 0 | 19.5 | 0.57 | 1005.8 | 567.6 | 43.6 |
| 2 | 34.9 | 3.2 | 0 | 19.5 | 0.56 | 1076.7 | 586.2 | 45.6 |
| 3 | 35.8 | 3.2 | 4 | 21.2 | 0.59 | 1006.4 | 636.2 | 36.8 |
| 4 | 34.9 | 3.2 | 8 | 22.5 | 0.64 | 1087.2 | 679.3 | 37.5 |

As shown in Table 14, the containers in accordance with the present disclosure were superior than the comparison containers. Inclusion of a dry strength chemistry preparation in the cellulose-based materials that prepared the containers demonstrated an increase in SCT and SCT Index values compared to the comparison containers made with cellulose-based materials that did not include a dry strength chemistry preparation. Furthermore, inclusion of a dry strength chemistry preparation in the cellulose-based materials that prepared the containers demonstrated an increase in BCT50 and BCT85 values compared to the comparison containers made with cellulose-based materials that did not include a dry strength chemistry preparation.

Example 8

Container Trial #4 [Plant B]

An exemplary container in accordance with certain aspects of the present disclosure is provided in the instant example. Evaluations in the instant example include short-span compression strength (SCT), SCT Index, box compression strength measured at 50% relative humidity (BCT50), and box compression strength measured at 85% relative humidity (BCT85).

For the instant example, different containers were prepared using various cellulose-based materials and then compared. Preparation of the containers comprised different cellulose-based materials that varied the basis weight of the material, the presence of a wet strength chemistry preparation, and the presence and amount of a dry strength chemistry preparation. The process for preparing the containers for the instant example were similar to those for Example 5.

The characteristics of the different containers are presented in Table 15.

TABLE 15

| Container No. | Basis Weight | Wet Strength (dry lbs/ton) | Dry Strength (dry lbs/ton) |
|---|---|---|---|
| 1 | 35.4 | 3.5 | 0 |
| 2 | 35.5 | 3.5 | 4 |
| 3 | 23.9 | 4 | 0 |
| 4 | 24.0 | 4 | 2 |
| 5 | 24.0 | 4 | 4 |
| 6 | 24.2 | 4 | 8 |
| 7 | 23.6 | 0 | 4 |

The process for preparing the containers for the instant example were similar to those for Example 6. Further, the methods of evaluating SCT, SCT Index, BCT50, and BCT85 values were identical to those in Example 6.

The evaluations and comparison of the containers prepared with different cellulose-based materials are presented in Table 16.

TABLE 16

| Container No. | Basis Weight | Wet Strength | Dry Strength | SCT (lbf/in) | SCT Index (SCT/BW) | BCT50 | BCT85 | BCT % Loss | % Box Strength Improvement at High Humidity |
|---|---|---|---|---|---|---|---|---|---|
| 1 | 35.4 | 3.5 | 0 | 19.6 | 0.55 | 1009.9 | 549.3 | 45.6 | |
| 2 | 35.5 | 3.5 | 4 | 21.9 | 0.62 | 1101.8 | 642.3 | 41.7 | |
| 3 | 23.9 | 4 | 0 | 13.4 | 0.56 | 501.0 | 317.2 | 36.7 | 0 |
| 4 | 24.0 | 4 | 2 | 14.2 | 0.59 | 535.9 | 333.5 | 37.8 | 4.89 |
| 5 | 24.0 | 4 | 4 | 13.9 | 0.58 | 546.7 | 345.0 | 36.9 | 8.06 |
| 6 | 24.2 | 4 | 8 | 16.0 | 0.66 | 532.9 | 341.6 | 35.9 | 7.14 |
| 7 | 23.6 | 0 | 4 | 13.8 | 0.58 | 520.5 | 327.4 | 37.1 | 3.12 |

Figure 2:
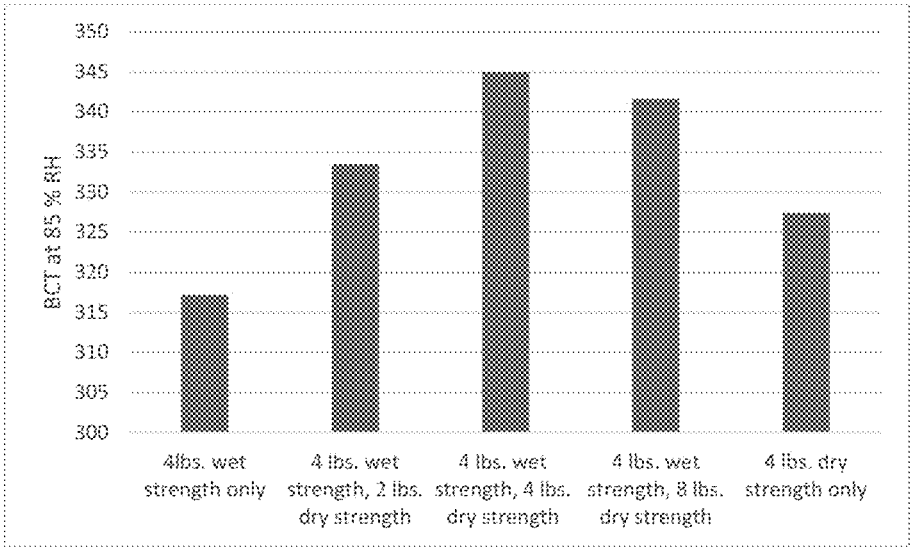
FIG. 2 shows that a higher BCT at 85% relative humidity for containers prepared using a combination of a dry strength chemistry preparation plus a wet strength preparation in the cellulose-based materials.

As shown in Table 16, the containers in accordance with the present disclosure were superior than the comparison containers. Inclusion of a dry strength chemistry preparation plus a wet strength preparation in the cellulose-based materials that prepared the containers demonstrated an increase in SCT and SCT Index values compared to the comparison containers made with cellulose-based materials that did not include a dry strength chemistry preparation. Furthermore, inclusion of a dry strength chemistry preparation plus a wet strength preparation in the cellulose-based materials that prepared the containers demonstrated an increase in BCT50 and BCT85 values compared to the comparison containers made with cellulose-based materials that did not include a dry strength chemistry preparation. FIG. 2 depicts that a higher BCT at 85% relative humidity RH was observed for containers prepared using a combination of a dry strength chemistry preparation plus a wet strength preparation in the cellulose-based materials.

Figure 3:
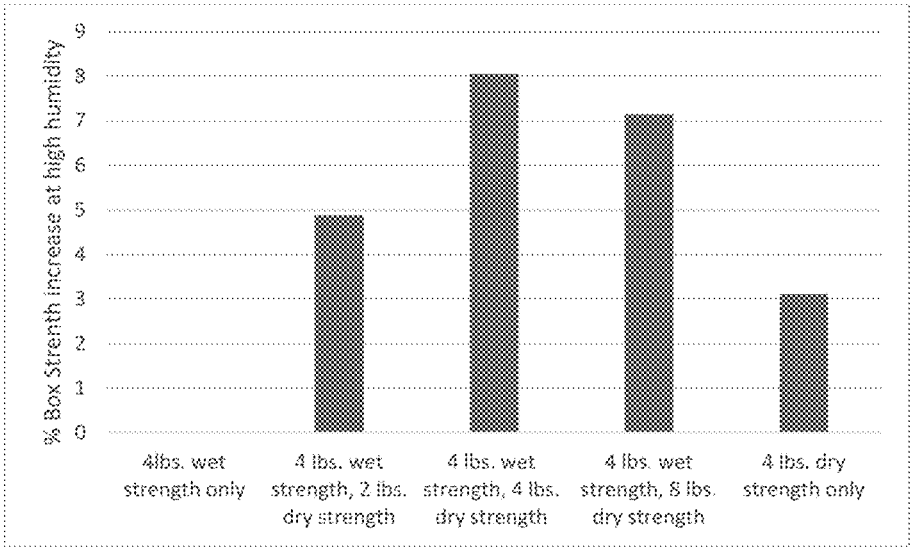
FIG. 3 shows a synergistic strength improvement was observed for containers prepared using a combination of a dry strength chemistry preparation plus a wet strength preparation in the cellulose-based materials.

Furthermore, a synergistic effect in strength improvement was observed for containers prepared using a combination of a dry strength chemistry preparation plus a wet strength preparation in the cellulose-based materials. These effects as demonstrated by Table 16, and as depicted in FIG. 3, were unexpected.

Example 9

Paper Trial #5

An exemplary cellulose-based material in accordance with certain aspects of the present disclosure is provided in the instant example. Evaluations in the instant example include short-span compression strength (SCT), SCT Index, and Concora values.

For the instant example, several different cellulose-based materials were prepared and compared. Preparation of the different cellulose-based materials included varying the basis weight of the material, the presence and amount of a wet strength chemistry preparation, and the presence and amount of a dry strength chemistry preparation.

The characteristics of the different cellulose-based materials are presented in Table 17.

TABLE 17

| Material No. | Basis Weight | Wet Strength (dry lbs/ton) | Dry Strength (dry lbs/ton) |
|---|---|---|---|
| 1 | 37.89 | 0 | 0 |
| 2 | 37.60 | 4 | 0 |
| 3 | 37.83 | 8 | 0 |
| 4 | 36.22 | 0 | 4 |
| 5 | 36.43 | 0 | 6 |
| 6 | 36.61 | 0 | 8 |
| 7 | 37.06 | 8 | 4 |
| 8 | 37.14 | 8 | 8 |

The process for preparing the cellulose-based materials for the instant example were similar to those for Example 1. Further, the methods of evaluating SCT, SCT Index, and related calculations were identical to those in Example 1.

The evaluations and comparison of the different cellulose-based materials are presented in Table 18.

TABLE 18

| Material No. | Basis Weight | Wet Strength (dry lbs/ton) | Dry Strength (dry lbs/ton) | SCT | SCT Index | SCT (BW normalized to 36 lbs/1000 ft$^2$) | % Strength Improvement |
|---|---|---|---|---|---|---|---|
| 1 | 37.89 | 0 | 0 | 19.28 | 0.51 | 18.36 | 0.00 |
| 2 | 37.60 | 4 | 0 | 19.15 | 0.51 | 18.36 | 0.00 |
| 3 | 37.83 | 8 | 0 | 20.29 | 0.54 | 19.44 | 5.88 |
| 4 | 36.22 | 0 | 4 | 19.32 | 0.53 | 19.08 | 3.92 |
| 5 | 36.43 | 0 | 6 | 18.57 | 0.51 | 18.36 | 0.00 |
| 6 | 36.61 | 0 | 8 | 19.15 | 0.52 | 18.72 | 1.96 |
| 7 | 37.06 | 8 | 4 | 20.68 | 0.56 | 20.16 | 9.80 |
| 8 | 37.14 | 8 | 8 | 21.32 | 0.57 | 20.52 | 11.76 |

Figure 4:
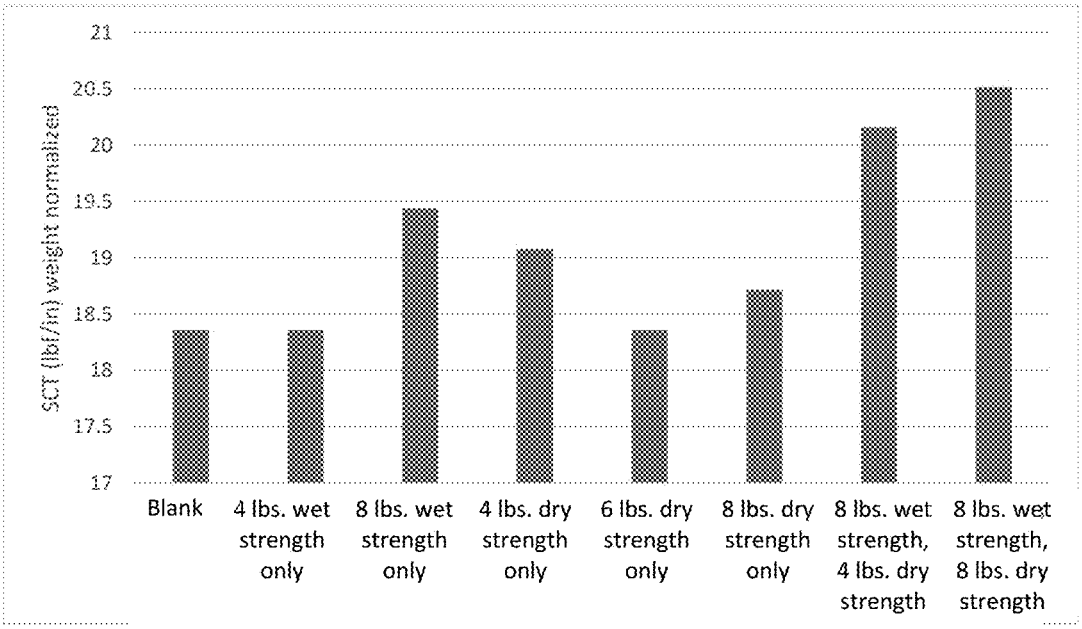
FIG. 4 shows that inclusion of a dry strength chemistry preparation plus a wet strength chemistry preparation demonstrated an increase in SCT when normalized to 36 lbs/1000 $ft^2$ compared to other cellulose-based materials that did not include a dry strength chemistry preparation.

As shown in Table 18, the cellulose-based material in accordance with the present disclosure was superior than the comparison cellulose-based materials. First, inclusion of a dry strength chemistry preparation plus a wet strength chemistry preparation demonstrated an increase in SCT and SCT Index compared to other cellulose-based materials that did not include a dry strength chemistry preparation. Second, as shown in FIG. 4, inclusion of a dry strength chemistry preparation plus a wet strength chemistry preparation demonstrated an increase in SCT when normalized to 36 lbs/1000 ft$^2$ compared to other cellulose-based materials that did not include a dry strength chemistry preparation.

Figure 5:
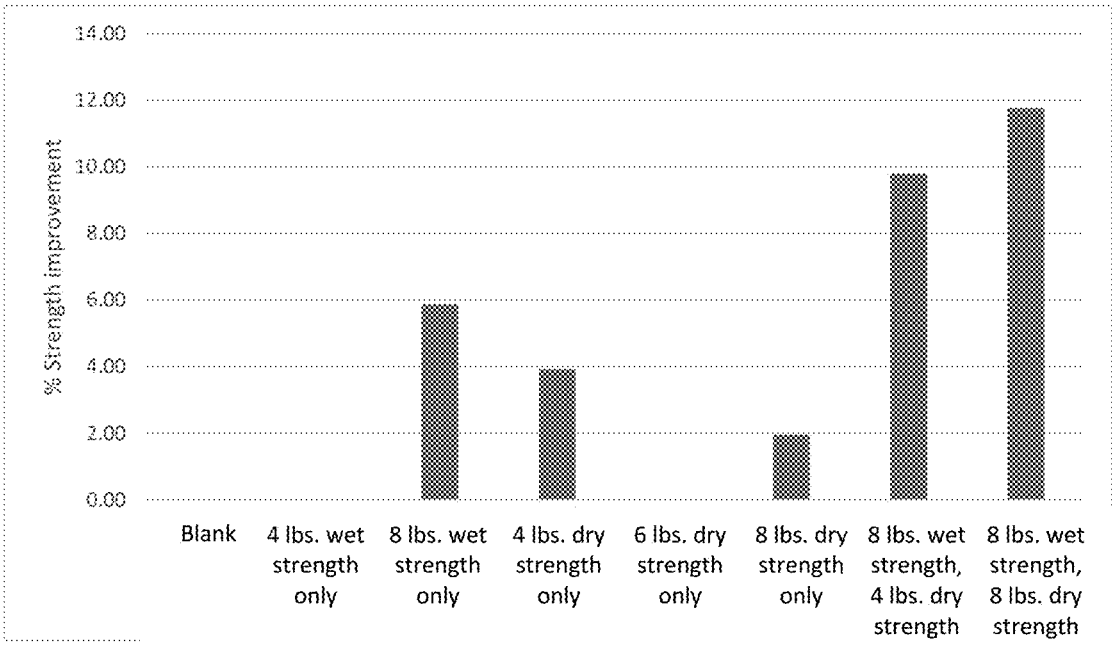
FIG. 5 shows a synergistic strength improvement was observed for containers prepared using a combination of a dry strength chemistry preparation plus a wet strength preparation in the cellulose-based materials.

Furthermore, a synergistic effect in strength improvement was observed for containers prepared using a combination of a dry strength chemistry preparation plus a wet strength preparation in the cellulose-based materials. These effects as demonstrated by Table 18, and as depicted in FIG. 5, were unexpected.

The invention claimed is:

1. A process for making a cellulose-based material, the process comprising the step of treating cellulosic fibers with i) a dry strength chemistry preparation comprising a glyoxalated polyacrylamide (GPAM) and ii) a wet strength chemistry preparation in a paper-making machine to provide the cellulose-based material.

2. The process of claim 1, wherein the cellulose-based material is capable of being recycled.

3. The process of claim 1, wherein the wet strength chemistry preparation comprises a polyamide resin.

4. The process of claim 1, wherein the cellulose-based material has a basis weight and a short-span compression strength (SCT), and wherein the SCT is greater than a comparative SCT for a comparative cellulose-based material made on the paper-making machine, wherein the comparative cellulose-based material having the basis weight and lacking the dry strength chemistry preparation.

5. The process of claim 1, wherein the cellulose-based material has a basis weight and a short-span compression strength (SCT), and wherein the dry strength chemistry preparation and the wet strength chemistry preparation provide a synergistic increase in SCT for the cellulose-based material in comparison to the comparative cellulose-based material.

6. The process of claim 1, wherein the cellulose-based material has a basis weight and a short-span compression strength index (SCT Index), and wherein the SCT Index is greater than a comparative SCT Index for a comparative cellulose-based material made on the paper-making machine, wherein the comparative cellulose-based material having the basis weight and lacking the dry strength chemistry preparation.

7. The process of claim 1, wherein the cellulose-based material has a basis weight and a short-span compression strength index (SCT Index), and wherein the dry strength chemistry preparation and the wet strength chemistry preparation provide a synergistic increase in SCT Index for the cellulose-based material in comparison to the comparative cellulose-based material.

8. The process of claim 1, wherein the cellulose-based material has a basis weight and a Concora value, and wherein the Concora value is greater than a comparative Concora value for a comparative cellulose-based material made on the paper-making machine, wherein the comparative cellulose-based material having the basis weight and lacking the dry strength chemistry preparation.

9. The process of claim 1, wherein the cellulose-based material has a basis weight and a Concora value, wherein the dry strength chemistry preparation and the wet strength chemistry preparation provide a synergistic increase in the Concora value for the cellulose-based material in comparison to the comparative cellulose-based material.

10. A process for making a container, the process comprising the steps of treating cellulosic fibers with i) a dry strength chemistry preparation comprising glyoxalated polyacrylamide (GPAM) and ii) a wet strength chemistry preparation in a paper-making machine to provide a cellulose-based material, and forming a container using the cellulose-based material.

11. The process of claim 10, wherein the cellulose-based material is capable of being recycled.

12. The process of claim 10, wherein the wet strength chemistry preparation comprises a polyamide resin.

13. The process of claim 10, wherein the process further comprises a step of treating cellulosic fibers with a sizing agent.

14. The process of claim 13, wherein the sizing agent is selected from the group consisting of alkenyl succinic anhydride (ASA), rosin, and alkyl ketene dimer (AKD).

15. The process of claim 10, wherein the container has a box compression strength (BCT50) measured at 50% relative humidity, and wherein the BCT50 is greater than a comparative box compression strength (CBCT50) measured at 50% relative humidity of a comparative container comprising comparative cellulose-based material made on the paper machine at the basis weight and lacking the dry strength chemistry preparation.

16. The process of claim 10, wherein the container has a box compression strength (BCT50) measured at 50% relative humidity, and wherein the dry strength chemistry preparation and the wet strength chemistry preparation provide a synergistic increase in BCT50 for the container in comparison to the comparative container.

17. The process of claim 10, wherein the container has a box compression strength (BCT85) measured at 85% relative humidity, and wherein the BCT85 is greater than a comparative box compression strength (CBCT85) measured at 85% relative humidity of a comparative container comprising comparative cellulose-based material made on the paper machine at the basis weight and lacking the dry strength chemistry preparation.

18. The process of claim 10, wherein the container has a box compression strength (BCT85) measured at 85% relative humidity, and wherein the dry strength chemistry preparation and the wet strength chemistry preparation provide a synergistic increase in BCT85 for the container in comparison to the comparative container.

19. A process for making a cellulose-based material, the process comprising the step of treating cellulosic fibers with i) a dry strength chemistry preparation and ii) a wet strength chemistry preparation in a paper-making machine to provide the cellulose-based material, wherein the cellulose-based material has a basis weight and a short-span compression strength (SCT), and wherein the SCT is greater than a comparative SCT for a comparative cellulose-based material made on the paper-making machine, wherein the comparative cellulose-based material having the basis weight and lacking the dry strength chemistry preparation.

* * * * *